US012618570B2

(12) United States Patent
Wang et al.

(10) Patent No.: US 12,618,570 B2
(45) Date of Patent: May 5, 2026

(54) AIR CONDITIONER

(71) Applicant: QINGDAO HISENSE HITACHI AIR-CONDITIONING SYSTEMS CO., LTD., Qingdao (CN)

(72) Inventors: Jiangnan Wang, Qingdao (CN); Yanjin Che, Qingdao (CN); Min Zhou, Qingdao (CN); Yongkun Gao, Qingdao (CN); Heng Zhang, Qingdao (CN)

(73) Assignee: QINGDAO HISENSE HITACHI AIR-CONDITIONING SYSTEMS CO., LTD., Qingdao (CN)

( * ) Notice: Subject to any disclaimer, the term of this patent is extended or adjusted under 35 U.S.C. 154(b) by 162 days.

(21) Appl. No.: 18/416,531

(22) Filed: Jan. 18, 2024

(65) Prior Publication Data

US 2024/0240808 A1 Jul. 18, 2024

Related U.S. Application Data

(63) Continuation of application No. PCT/CN2022/130394, filed on Nov. 7, 2022.

(30) Foreign Application Priority Data

| | | |
|---|---|---|
| Dec. 7, 2021 | (CN) | 202111484727.8 |
| Jan. 4, 2022 | (CN) | 202210000948.1 |
| Feb. 22, 2022 | (CN) | 202220357510.4 |

(51) Int. Cl.
*F24F 3/06* (2006.01)
*F24F 11/84* (2018.01)
(Continued)

(52) U.S. Cl.
CPC ..... *F24F 3/06* (2013.01); *F24F 11/84* (2018.01); *F25B 43/003* (2013.01); *F24F 2140/20* (2018.01)

(58) Field of Classification Search
CPC ..... F24F 3/06; F24F 11/84; F24F 2140/20; F25B 43/003
See application file for complete search history.

(56) References Cited

U.S. PATENT DOCUMENTS

| | | | |
|---|---|---|---|
| 5,987,907 | A | 11/1999 | Morimoto et al. |
| 2015/0211772 | A1 | 7/2015 | Shimazu |
| 2020/0256590 | A1 | 8/2020 | Nishiyama |

FOREIGN PATENT DOCUMENTS

| | | | |
|---|---|---|---|
| CN | 1425887 | A | 6/2003 |
| CN | 1828186 | A | 9/2006 |

(Continued)

OTHER PUBLICATIONS

International Search Report and Written Opinion dated Dec. 12, 2022 in corresponding International Application No. PCT/CN2022/130394, translated, 18 pages.

(Continued)

*Primary Examiner* — Nael N Babaa
(74) *Attorney, Agent, or Firm* — MH2 TECHNOLOGY LAW GROUP LLP

(57) ABSTRACT

An air conditioner includes an outdoor unit, a plurality of indoor units, and a controller. The outdoor unit includes a first throttling device. The indoor unit includes a second throttling device. The controller is configured to: regulate an opening degree of the first throttling device, so that a first supercooling temperature is within a first supercooling temperature range in a case where the air conditioner is in a cooling mode; regulate opening degrees of a plurality of second throttling devices in a case where the air conditioner is in a heating mode, so that a plurality of second supercooling temperatures are each within a second supercooling temperature range, and an absolute value of a difference between each of the plurality of second supercooling tem- (Continued)

peratures and an average value of the plurality of second supercooling temperatures is less than or equal to a first threshold.

19 Claims, 8 Drawing Sheets

(51) Int. Cl.
*F25B 43/00* (2006.01)
*F24F 140/20* (2018.01)

(56) References Cited

FOREIGN PATENT DOCUMENTS

| | | | |
|---|---|---|---|
| CN | 101509693 | A | 8/2009 |
| CN | 101539322 | A | 9/2009 |
| CN | 102401523 | A | 4/2012 |
| CN | 203100306 | U | 7/2013 |
| CN | 103807917 | A | 5/2014 |
| CN | 104896785 | A | 9/2015 |
| CN | 106196787 | A | 12/2016 |
| CN | 109668357 | A | 4/2019 |
| CN | 111247377 | A | 6/2020 |
| CN | 113074432 | A | 7/2021 |
| CN | 113074447 | A | 7/2021 |
| CN | 113203165 | A | 8/2021 |
| CN | 113587253 | A | 11/2021 |
| CN | 114151934 | A | 3/2022 |
| CN | 114322106 | A | 4/2022 |
| CN | 216844913 | U | 6/2022 |
| EP | 2009369 | A1 | 12/2008 |
| EP | 3002532 | A1 | 4/2016 |
| JP | 2006162235 | A | 6/2006 |
| WO | 2014065094 | A1 | 5/2014 |

OTHER PUBLICATIONS

Chinese First Office Action dated Nov. 3, 2022 in corresponding Chinese Application No. 202111484727.8, translated, 18 pages.
Chinese First Office Action dated Dec. 29, 2022 in corresponding Chinese Application No. 202210000948.1, translated, 18 pages.
Chinese Second Office Action dated May 5, 2023 in corresponding Chinese Application No. 202210000948.1, translated, 16 pages.

AIR CONDITIONER

CROSS-REFERENCE TO RELATED APPLICATIONS

This application is a continuation application of International Patent Application No. PCT/CN2022/130394, filed on Nov. 7, 2022, which claims priority to Chinese Patent Application No. 202111484727.8, filed on Dec. 7, 2021; Chinese Patent Application No. 202210000948.1, filed on Jan. 4, 2022; and Chinese Patent Application No. 202220357510.4, filed on Feb. 22, 2022, which are incorporated herein by reference in their entireties.

TECHNICAL FIELD

The present disclosure relates to the field of air conditioning technologies and, in particular, to an air conditioner.

BACKGROUND

Air conditioners utilize vaporization and liquefaction of refrigerant to absorb or release heat, so as to regulate a temperature of indoor space. Therefore, the appropriate amount of refrigerant is the basis for the stable and efficient operation of the air conditioners. If the amount of refrigerant involved in the cycle in the air conditioner exceeds the amount of refrigerant required by the air conditioner, it may lead to the presence of liquid refrigerant at an air inlet of the compressor, thereby causing damage to the compressor. If the amount of refrigerant involved in the cycle in the air conditioner is less than the amount of refrigerant required by the air conditioner, it may lead to insufficient refrigerant in the indoor unit, which may not satisfy the cooling or heating needs of the user.

SUMMARY

An air conditioner is provided. The air conditioner includes an outdoor unit, a plurality of indoor units, and a controller. The outdoor unit includes a compressor, a first heat exchanger, a liquid storage device, and a first throttling device. The compressor is configured to compress a refrigerant, so as to drive the refrigerant to circulate in the air conditioner. The first heat exchanger is configured to perform one of liquefaction and vaporization of the refrigerant. The liquid storage device is configured to store the refrigerant. A first end of the first throttling device communicates with a liquid side of the first heat exchanger, and a second end of the first throttling device communicates with the liquid storage device. The first throttling device is configured to regulate a flow rate of the refrigerant flowing through the first throttling device. The plurality of indoor units communicate with the outdoor unit, and each of the plurality of indoor units includes a second heat exchanger and a second throttling device. The second heat exchanger is configured to perform another one of the liquefaction and the vaporization of the refrigerant. A first end of the second throttling device communicates with a liquid side of the second heat exchanger, and a second end of the second throttling device communicates with the liquid storage device. The second throttling device is configured to regulate a flow rate of the refrigerant flowing through the second throttling device. The controller is coupled to the first throttling device and the second throttling device. The controller is configured to regulate an amount of the refrigerant in the in the liquid storage device by regulating an opening degree of at least one of the first throttling device or the second throttling device, so as to regulate the amount of refrigerant participating in a cycle in the air conditioner. The controller is further configured to: regulate the opening degree of the first throttling device, in a case where the air conditioner is in a cooling mode, so that a first supercooling temperature of the liquid side of the first heat exchanger is within a preset first supercooling temperature range; and regulate the opening degrees of the plurality of second throttling devices, in a case where the air conditioner is in a heating mode, so that a plurality of second supercooling temperatures of the liquid sides of the plurality of second heat exchangers each are within a preset second supercooling temperature range, and an absolute value of a difference between each of the plurality of second supercooling temperatures and an average value of the plurality of second supercooling temperatures is less than or equal to a preset first threshold.

DETAILED DESCRIPTION

Figure 1:
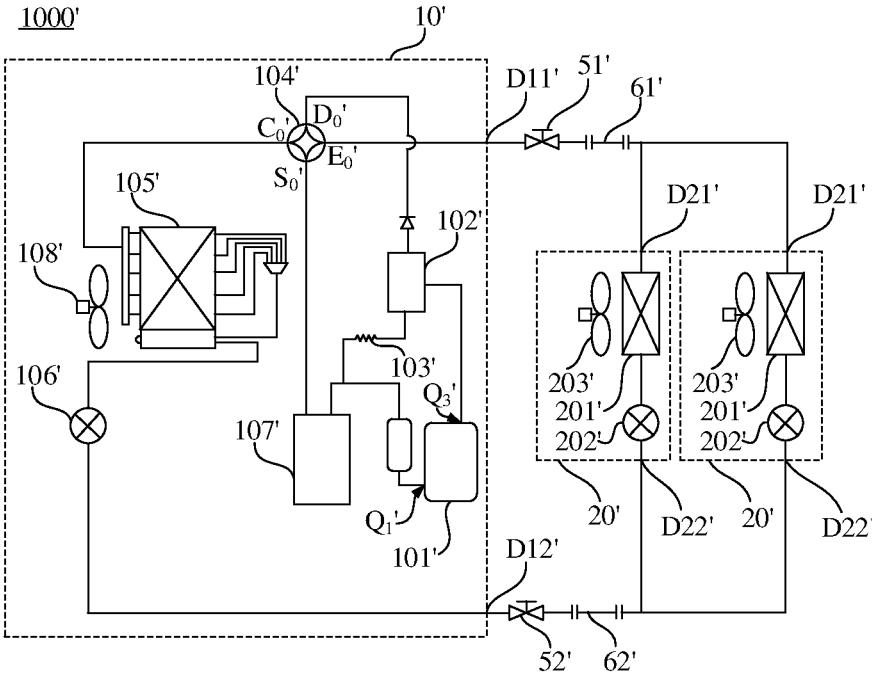
FIG. 1 is a diagram showing a structure of an air conditioner in the related art.

Some embodiments of the present disclosure will be clearly and completely described below with reference to the accompanying drawings. However, the described embodiments are merely some but not all embodiments of the present disclosure. All other embodiments obtained by a person of ordinary skill in the art based on embodiments of the present disclosure shall be included in the protection scope of the present disclosure.

Unless the context requires otherwise, throughout the specification and the claims, the term "comprise" and other forms thereof such as the third-person singular form "comprises" and the present participle form "comprising" are construed as an open and inclusive meaning, i.e., "including, but not limited to." In the description of the specification, the terms such as "one embodiment," "some embodiments," "exemplary embodiments," "example," "specific example," or "some examples" are intended to indicate that specific features, structures, materials, or characteristics related to the embodiment(s) or example(s) are included in at least one embodiment or example of the present disclosure. Schematic representations of the above terms do not necessarily refer to the same embodiment(s) or example(s). In addition, the specific features, structures, materials, or characteristics may be included in any one or more embodiments or examples in any suitable manner.

Hereinafter, the terms such as "first" and "second" are used for descriptive purposes only and are not to be construed as indicating or implying the relative importance or implicitly indicating the number of indicated technical features. Thus, features defined by "first" or "second" may explicitly or implicitly include one or more of the features. In the description of the embodiments of the present disclosure, the term "a plurality of" or "the plurality of" means two or more unless otherwise specified.

In the description of the embodiments, the terms "coupled" and "connected" and their derivatives may be used. The term "connected" should be understood in a broad sense. For example, the term "connected" may represent a fixed connection, a detachable connection, or a one-piece connection, or may represent a direct connection, or may represent an indirect connection through an intermediate medium. The term "coupled" may be used in the description of some embodiments to indicate that two or more components are in direct physical or electrical contact with each other. However, the term "coupled" or "communicatively coupled" may also mean that two or more elements are not in direct contact with each other, but still cooperate or interact with each other. The embodiments disclosed herein are not necessarily limited to the content herein.

The phrase "at least one of A, B, and C" has the same meaning as the phrase "at least one of A, B, or C," both including the following combinations of A, B, and C: only A, only B, only C, a combination of A and B, a combination of A and C, a combination of B and C, and a combination of A, B, and C.

As used herein, the term "if" is, optionally, construed as "when" or "in a case where" or "in response to determining that" or "in response to detecting," depending on the context. Similarly, depending on the context, the phrase "if it is determined that" or "if [a stated condition or event] is detected" is optionally construed as "in a case where it is determined that" or "in response to determining that" or "in a case where [the stated condition or event] is detected" or "in response to detecting [the stated condition or event]."

The use of the phrase "configured to" herein means an open and inclusive expression, which does not exclude devices that are configured to perform additional tasks or steps.

In addition, the use of the phrase "based on" herein has an open and inclusive meaning, since a process, step, calculation, or other actions that is "based on" one or more of the stated conditions or values may, in practice, be based on additional conditions or values exceeding those stated.

Generally, an air conditioner 1000' includes an outdoor unit 10' and at least one indoor unit 20' as shown in FIG. 1. The outdoor unit 10' is a device installed in a region such as an outer wall of or a roof of a house in the air conditioner 1000'. The outdoor unit 10' is mainly configured to perform heat exchange with the outdoor environment. The indoor unit 20' is a device installed indoors in the air conditioner 1000'. The indoor unit 20' is mainly configured to release cold air or hot air to indoor space where the indoor unit 20' is located, so as to regulate a temperature of the indoor space.

With continued reference to FIG. 1, the outdoor unit 10' communicates with the at least one indoor unit 20' through at least two pipes. A first shut-off valve 51' is disposed on a first pipe 61' communicating a first end D11' of the outdoor unit 10' with a first end D21' of the indoor unit 20', so as to control the opening and closing of the first pipe 61'. A second shut-off valve 52' is disposed on a second pipe 62' communicating a second end D12' of the outdoor unit 10' with a second end D22' of the indoor unit 20', so as to control the opening and closing of the second pipe 62'. The first pipe 61' and the second pipe 62' may also be collectively referred to as piping.

Outdoor unit 10' includes a compressor 101', an oil separator 102', a pressure reducing device 103', a four-way valve 104', a first heat exchanger 105', a first throttling device 106', a gas-liquid separator 107', and a first motor fan 108'. The compressor 101' is mainly configured to compress a refrigerant and drive the refrigerant to circulate in the air conditioner 1000'. The refrigerant is a substance that easily absorbs heat and becomes gas and also easily releases heat and becomes liquid.

An air outlet Q3' of the compressor 101' is communicated with a first end of the oil separator 102', a second end of the oil separator 102' is communicated with a first end of the pressure reducing device 103', and a second end of the pressure reducing device 103' is communicated with a first air inlet Q1' of the compressor 101'. A third end of the oil separator 102' is communicated with a port D0' of the four-way valve 104'. A port C0' of the four-way valve 104' is communicated with a gas side of the first heat exchanger 105', and a liquid side of the first heat exchanger 105' is communicated with a first end of the first throttling device 106'. A second end of the first throttling device 106' is communicated with a first end of the second pipe 62'. A port E0' of the four-way valve 104' is communicated with a first end of the first pipe 61', and a port S0' of the four-way valve 104' is communicated with an air inlet of the gas-liquid separator 107'. An air outlet of the gas-liquid separator 107' is communicated with a first air inlet Q1' of the compressor 101'. Here, the pressure reducing device 103' may include a capillary tube. The capillary tube is usually a thin and long copper tube.

Each of the at least one indoor unit 20' includes a second heat exchanger 201', a second throttling device 202', and a second motor fan 203'. A gaseous side of the second heat exchanger 201' is communicated with a second end of the first pipe 61', and a liquid side of the second heat exchanger 201' is communicated with a first end of the second throttling device 202'. A second end of the second throttling device 202' is communicated with a second end of the second pipe 62'.

It will be noted that the gaseous side refers to a side of the first heat exchanger 105' or the second heat exchanger 201' proximate to the compressor 101', and the refrigerant in a pipeline corresponding to the gaseous side is mainly in a gaseous state; the liquid side refers to a side of the first heat exchanger 105' or the second heat exchanger 201' away from the compressor 101', and the refrigerant in a pipeline corresponding to the liquid side is mainly in a liquid state.

Figure 2:
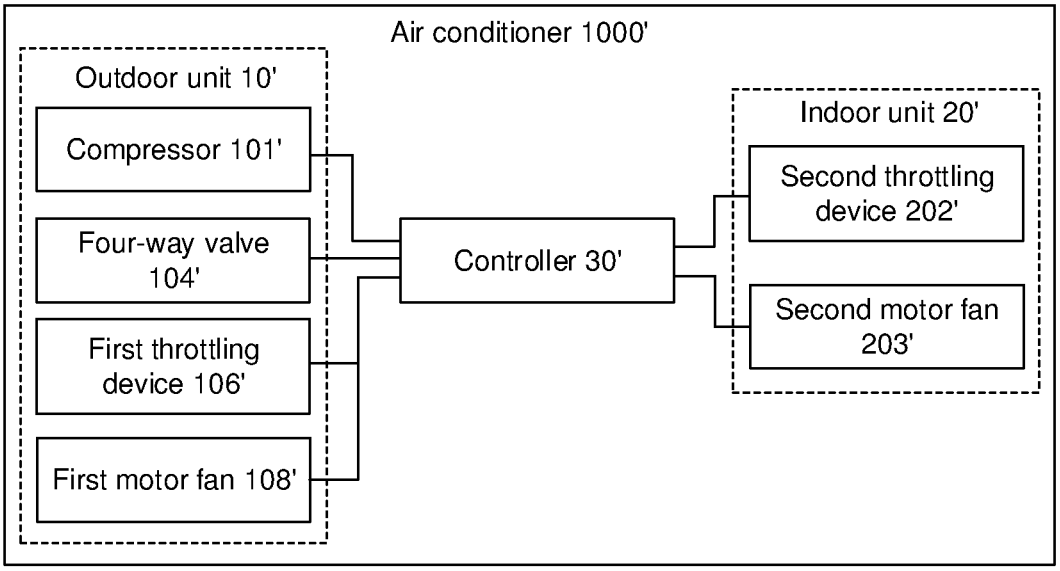
FIG. 2 is a block diagram of an air conditioner in the related art.

As shown in FIG. 2, the air conditioner 1000' further includes a controller 30'. The controller 30' is coupled to the compressor 101', the four-way valve 104', the first throttling device 106', and the first motor fan 108' in the outdoor unit 10' and is coupled to the second throttling device 202' and the second motor fan 203' in the indoor unit 20'. The controller 30' is configured to control operating states of the components coupled to the controller 30'.

In some embodiments, the air conditioner 1000' operates in a cooling mode, so as to reduce the temperature of the indoor space. In the cooling mode, the controller 30' controls the compressor 101' to operate, and controls the port $D_0'$ of the four-way valve 104' to communicate with the port $C_0'$ of the four-way valve 104', and the port $S_0'$ of the four-way valve 104' to communicate with the port $E_0'$ of the four-way valve 104'. In addition, the controller 30' further controls the first throttling device 106', the second throttling device 202', the first shut-off valve 51', and the second shut-off valve 52' to be opened.

In this way, the compressor 101' compresses a gaseous refrigerant to obtain a gaseous refrigerant with high temperature and high pressure and drives the compressed refrigerant to enter the oil separator 102'. There may be engine oil in the refrigerant discharged from the air outlet $Q_3'$ of the compressor 101', and the oil separator 102' may separate the engine oil from the refrigerant. As a result, the separated engine oil may return to the first air inlet $Q_1'$ of the compressor 101' through the pressure reducing device 103', and the gaseous refrigerant with high temperature and high pressure may reach the gaseous side of the first heat exchanger 105' and enter into the first heat exchanger 105' after passing through the port $D_0'$ and the port $C_0'$ of the four-way valve 104'.

After the gaseous refrigerant with high temperature and high pressure is liquefied into a liquid refrigerant with low temperature and low pressure in the first heat exchanger 105', the liquid refrigerant with low temperature and low pressure sequentially passes through the liquid side of the first heat exchanger 105', the first throttling device 106', the second shut-off valve 52', and the second throttling device 202' and reaches the liquid side of the second heat exchanger 201', and then enters into the second heat exchanger 201'.

The liquid refrigerant with low temperature and low pressure is vaporized into the gaseous refrigerant in the second heat exchanger 201', so as to absorb heat around the second heat exchanger 201', thereby achieving the effect of reducing the temperature of indoor space. Then, the vaporized gaseous refrigerant passes through the gaseous side of the second heat exchanger 201' and the first shut-off valve 51' and reaches the four-way valve 104', and then reaches the air inlet of the gas-liquid separator 107' through the port $E_0'$ and the port $S_0'$ of the four-way valve 104'. The gaseous refrigerant may condense to produce liquid during the transportation from the second heat exchanger 201' to the gas-liquid separator 107'. The gas-liquid separator 107' separates the liquid from the gaseous refrigerant, and then makes the gaseous refrigerant enter into the compressor 101', so as to achieve the recycling of the refrigerant.

In some other embodiments, the air conditioner 1000' operates in a heating mode, so as to increase the temperature of indoor space. Unlike the cooling mode, in the heating mode, the controller 30' controls the port $D_0'$ of the four-way valve 104' to communicate with the port $E_0'$, and the port $S_0'$ to communicate with the port $C_0'$.

In this way, the obtained gaseous refrigerant with high temperature and high pressure compressed by the compressor 101' passes through the port $D_0'$ and port $E_0'$ of the four-way valve 104' and enters into the second heat exchanger 201' from the gaseous side of the second heat exchanger 201'. The gaseous refrigerant with high temperature and high pressure is liquefied into the liquid refrigerant with low temperature and low pressure in the second heat exchanger 201', so as to release heat to the surrounding of the second heat exchanger 201', thereby achieving the effect of increasing the temperature of indoor space. Then, the liquid refrigerant with low temperature and low pressure flows from the liquid side of the second heat exchanger 201' and enters into the first heat exchanger 105' from the liquid side of the first heat exchanger 105'. The liquid refrigerant with low temperature and low pressure is vaporized into the gaseous refrigerant in the first heat exchanger 105', and then enters into the gas-liquid separator 107' through the port $C_0'$ and the port $S_0'$ of the four-way valve 104', and finally returns to the compressor 101'.

In the cooling mode or the heating mode, the first motor fan 108' (or the second motor fan 203') is configured to start operating due to the control of the controller 30', so as to discharge the heat generated by the liquefaction of the refrigerant or the cold generated by the vaporization of the refrigerant in the first heat exchanger 105' (or the second heat exchanger 201') from the outdoor unit 10' (or the indoor unit 20').

In addition, in the cooling mode, since the first heat exchanger 105' is configured to liquefy the refrigerant and the second heat exchanger 201' is configured to vaporize the refrigerant, the first heat exchanger 105' may be referred to as a condenser, and the second heat exchanger 201' may be referred to as an evaporator. Similarly, in the heating mode, the first heat exchanger 105' may be referred to as an evaporator, and the second heat exchanger 201' may be referred to as a condenser.

Usually, when installing the air conditioner 1000', the installer needs to supplement refrigerant into the compressor 101' of the air conditioner 1000', so that the amount of refrigerant in the air conditioner 1000' may satisfy the cooling or heating demand of the users during daily use.

However, in different operating conditions, the amount of refrigerant required for the normal operation of the air conditioner 1000' is different. For example, the amount of refrigerant required by the air conditioner 1000' in the cooling mode is generally greater than the amount of refrigerant required by the air conditioner 1000' in the heating mode. For another example, the longer the piping connecting the indoor unit 10' and the outdoor unit 20', the greater the amount of refrigerant required for the air conditioner 1000'. Therefore, if the air conditioner 1000' operates with constant amount of refrigerant in different operating conditions, the amount of refrigerant involved in a cycle in the air conditioner 1000' may not match the actual amount of refrigerant required by the air conditioner 1000', thereby affecting the operating effect of the air conditioner 1000'.

In response to the above problems, research has found that: in the cooling mode (or the heating mode), if a supercooling temperature of the liquid side of the first heat exchanger 105' (or the second heat exchanger 201') of the air conditioner 1000' is within a preset range, the air conditioner 1000' may operate stably and efficiently. In addition, there is a positive correlation between the amount of refrigerant involved in the cycle in the air conditioner 1000' and the supercooling temperature of the liquid side of the first heat exchanger 105' (or the second heat exchanger 201'). Therefore, the amount of refrigerant required by the air conditioner 1000' operating efficiently in the cooling mode and the heating mode may be determined according to the supercooling temperature of the liquid side of the first heat exchanger 105' and the supercooling temperature of the liquid side of the second heat exchanger 201'. As a result, the amount of refrigerant involved in the cycle of the air conditioner 1000' in different operating conditions may be accurately controlled, thereby improving the operating effect of the air conditioner 1000'.

In some embodiments of the present disclosure, an air conditioner 1000 is provided based on the above technical concept. The air conditioner 1000 is additionally provided with a liquid storage device 109. In this way, during the operation of the air conditioner 1000, the liquid storage device 109 may be configured to supplement the refrigerant to the air conditioner 1000 to participate in the cycle, or the refrigerant in the air conditioner 1000 that does not need to participate in the cycle may be stored in the liquid storage device 109, so as to adapt to the demand of the amount of refrigerant in the air conditioner 1000 in different operating conditions.

Figure 3:
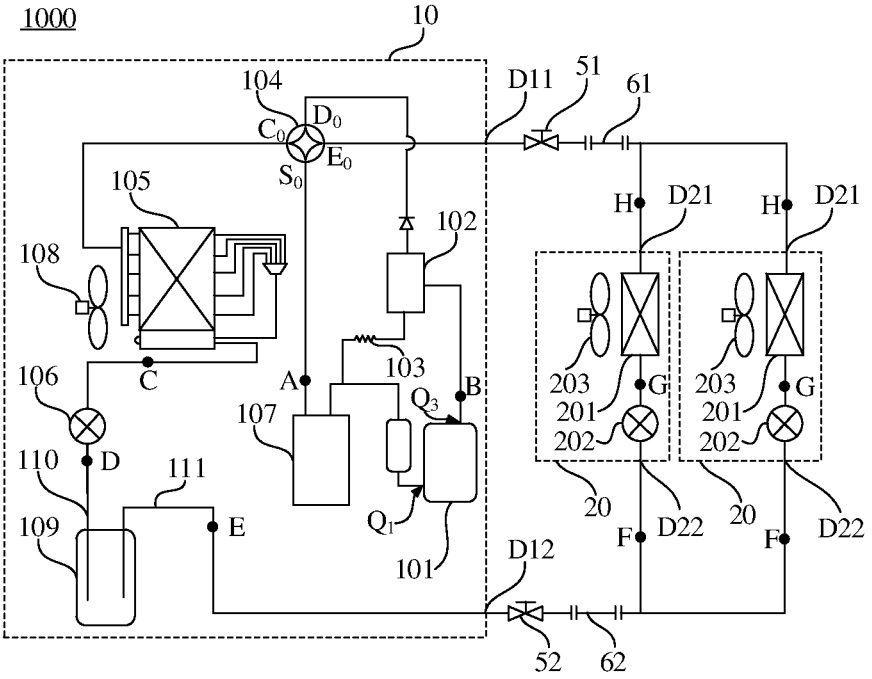
FIG. 3 is a diagram showing a structure of an air conditioner, in accordance with some embodiments.
Figure 4:
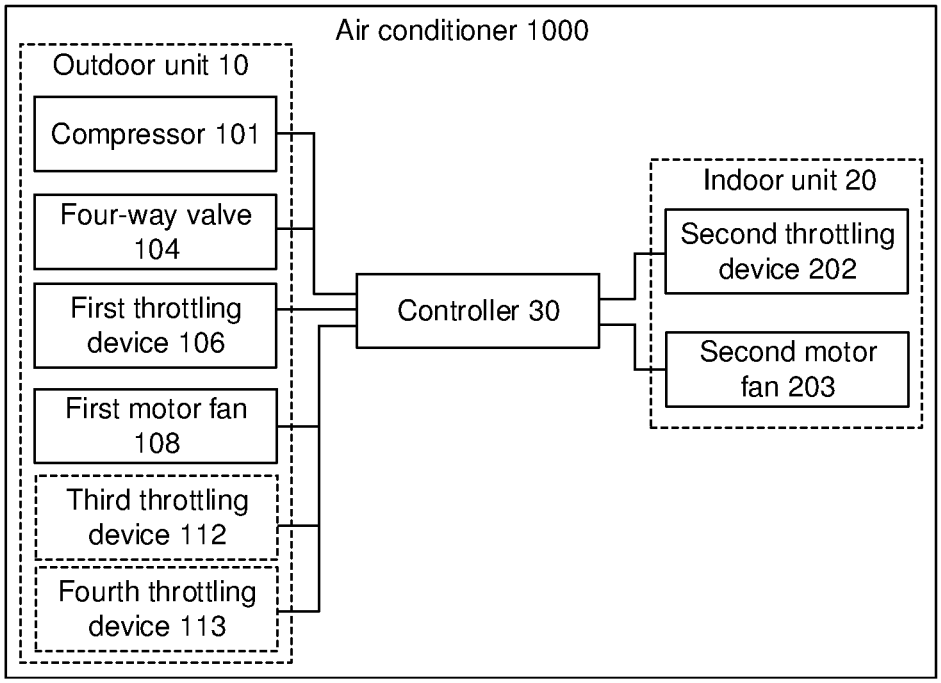
FIG. 4 is a block diagram of an air conditioner, in accordance with some embodiments.

As shown in FIGS. 3 and 4, the air conditioner 1000 includes an outdoor unit 10, one or more indoor units 20, and a controller 30.

The outdoor unit 10 includes a compressor 101 configured to compress the refrigerant and drive the refrigerant to circulate in the air conditioner 1000.

The outdoor unit 10 further includes a first heat exchanger 105 configured to perform one of the liquefaction and the vaporization of the refrigerant.

The outdoor unit 10 further includes a liquid storage device 109 configured to store the refrigerant.

The outdoor unit 10 further includes a first throttling device 106 and a first transporting pipe 110. A first end of the first throttling device 106 is communicated with the liquid side of the first heat exchanger 105, and a second end of the first throttling device 106 is communicated with the liquid storage device 109 through the first transporting pipe 110. The first throttling device 106 is configured to regulate a flow rate of the refrigerant flowing through the first throttling device 106. For example, the first throttling device 106 regulates a flow rate of the refrigerant in the first transporting pipe 110.

One or more indoor units 20 are communicated with the outdoor unit 10, and each indoor unit 20 includes a second heat exchanger 201 configured to perform another one of the liquefaction and the vaporization of the refrigerant.

The indoor unit 20 further includes a second throttling device 202. A first end of the second throttling device 202 is communicated with the liquid side of the second heat exchanger 201, and a second end of the second throttling device 202 is communicated with the liquid storage device 109 through a second transporting pipe 111. The second throttling device 202 is configured to regulate a flow rate of the refrigerant flowing through the second throttling device 202. For example, the second throttling device 202 regulates a flow rate of the refrigerant in the second transporting pipe 111. Here, the outdoor unit 10 further includes the second transporting pipe 111, and the second transporting pipe 111 is connected to the indoor unit 20.

The controller 30 is coupled to the first throttling device 106 and the second throttling device 202 and is configured to: in a case where the air conditioner 1000 is in the cooling mode, regulate an opening degree of the first throttling device 106, so that a first supercooling temperature SC1 of the liquid side of the first heat exchanger 105 may be within a preset first supercooling temperature range. In this way, it is possible to regulate the amount of refrigerant in the liquid storage device 109, thereby regulating the amount of refrigerant participating in the cycle in the air conditioner 1000.

The controller 30 is further configured to: in a case where the air conditioner 1000 is in the heating mode, regulate an opening degree of the second throttling device 202, so that a second supercooling temperature SC2 of the liquid side of the second heat exchanger 201 may be within a preset second supercooling temperature range. In this way, it is possible to regulate the amount of refrigerant in the liquid storage device 109, thereby regulating the amount of refrigerant participating in the cycle in the air conditioner 1000.

The controller 30 includes a processor. The processor may include a central processing unit (CPU), a microprocessor, or an application specific integrated circuit (ASIC), and the processor may be configured to execute the corresponding operations described in the controller 30 when the processor executes a program stored in a non-transitory computer-readable media coupled to the controller 30.

In the air conditioner 1000 provided by some embodiments of the present disclosure, it is possible to accurately determine the amount of refrigerant required to participate in a cooling (or heating) cycle in the air conditioner 1000 according to the positive correlation between the first supercooling temperature SC1 of the liquid side of the first heat exchanger 105 (or the second supercooling temperature SC2 of the liquid side of the second heat exchanger 201) and the amount of refrigerant required by the air conditioner 1000 in the cooling mode (or the heating mode).

In this way, in a case where the amount of refrigerant determined according to the supercooling temperature is greater than the amount of refrigerant required by the air conditioner 1000, the controller 30 may increase a dryness fraction of the refrigerant in the liquid storage device 109 by regulating the opening degree of the first throttling device 106 or the opening degree of the second throttling device 202, so that the refrigerant stored in the liquid storage device 109 may participate in the cycle.

In a case where the amount of refrigerant determined according to the supercooling temperature is less than the amount of refrigerant required by the air conditioner 1000, the controller 30 may reduce the dryness fraction of the refrigerant in the liquid storage device 109 by regulating the opening degree of the first throttling device 106 or the opening degree of the second throttling device 202, thereby storing redundant refrigerant in the liquid storage device 109. Therefore, the air conditioner 1000 may adaptively allocate the amount of refrigerant participating in the cycle in the air conditioner 1000 and the amount of refrigerant stored in the liquid storage device 109, so that the air conditioner 1000 may operate with the appropriate amount of refrigerant, thereby improving the operating effect of the air conditioner 1000.

Here, the dryness fraction may refer to a ratio of mass of gaseous refrigerant in a unit volume of refrigerant to total mass of the refrigerant.

In some embodiments, as shown in FIG. 3, the outdoor unit 10 further includes an oil separator 102 configured to separate the engine oil from the gaseous refrigerant discharged from the compressor 101.

In some embodiments, as shown in FIG. 3, the outdoor unit 10 further includes a pressure reducing device 103 configured to reduce a pressure of the refrigerant flowing therethrough.

In some embodiments, as shown in FIG. 3, the outdoor unit 10 further includes a four-way valve 104. The four-way valve 104 is connected to the refrigerant loop of the air conditioner 1000 and configured to switch a flow direction of the refrigerant in the refrigerant loop, so that the air conditioner 1000 may perform a cooling mode or a heating mode.

In some embodiments, as shown in FIG. 3, the outdoor unit 10 further includes a gas-liquid separator 107 configured to separate the gaseous refrigerant from the liquid refrigerant.

In some embodiments, as shown in FIG. 3, the outdoor unit 10 further includes a first motor fan 108. The first motor fan 108 is configured to draw the outdoor air into the outdoor unit 10 through an air inlet of the outdoor unit 10 and exhaust the outdoor air after heat exchange with the first heat exchanger 105 through an air outlet of the outdoor unit 10.

In some embodiments, as shown in FIG. 3, the indoor unit 20 further includes a second motor fan 203 configured to draw the indoor air into the indoor unit 20 through an air inlet of the indoor unit 20 and exhaust the indoor air after heat exchange with the second heat exchanger 201 through an air outlet of the indoor unit 20.

In some embodiments, as shown in FIG. 3, the air conditioner 1000 further includes a first pipe 61 and a second pipe 62 connecting the outdoor unit 10 and the indoor unit 20. A first shut-off valve 51 is disposed on the first pipe 61, and a second shut-off valve 52 is disposed on the second pipe 62. In this case, the second transporting pipe 111 is connected to the second end of the second throttling device 202 through the second pipe 62, and the second throttling device 202 may adjust the flow rate of the refrigerant flowing through the second transporting pipe 111 and the second pipe 62.

For the connecting relationship and operating manners of the above components, reference may be made to the relevant content of the air conditioner 1000', and details will not be repeated herein. Here, components with a same name and different reference signs are approximately the same in structure and function. In addition, the first transporting pipe 110 of the air conditioner 1000 is a pipe connecting the first throttling device 106 and the liquid storage device 109, and the second transporting pipe 111 is a pipe connecting the second throttling device 202 and the liquid storage device 109.

In some embodiments, the first throttling device 106 and the second throttling device 202 are electronic expansion valves. The opening degree may refer to a size of the opened channel of the electronic expansion valve. In a case where the first throttling device 106 and the second throttling device 202 are partially opened (i.e., not fully opened), the first throttling device 106 and the second throttling device 202 may play a throttling role on the refrigerant in the first transporting pipe 110 and the second transporting pipe 111, respectively, so that the pressure and temperature of the refrigerant in the first transporting pipe 110 and the second transporting pipe 111 may be reduced. The decrease in pressure of the refrigerant leads to a decrease in saturation temperature. In this way, flashing of the refrigerant occurs and the amount of gaseous refrigerant increases, so that the dryness fraction of the refrigerant in the first transporting pipe 110 and the second transporting pipe 111 may be increased.

In some embodiments, the first supercooling temperature SC1 is a difference between a saturation temperature Tdc of the refrigerant in an exhaust pressure Pd of the compressor 101 and a temperature Te1 of the liquid side of the first heat exchanger 105 (i.e., SC1=Tdc−Te1). The second supercooling temperature SC2 is a difference between the saturation temperature Tdc and a temperature Te2 of the liquid side of the second heat exchanger 201 (i.e., SC2=Tdc−Te2).

For example, the controller 30 obtains the exhaust pressure Pd through a pressure sensor disposed at the air outlet Q3 of the compressor 101 and calculates (or inquiry) the saturation temperature Tdc of the refrigerant in the exhaust pressure Pd according to a calculating formula (or a table) stored in the air conditioner 1000 in advance. Moreover, the controller 30 may obtain the temperature Te1 through a temperature sensor disposed on the liquid side of the first heat exchanger 105 and obtain the temperature Te2 through a temperature sensor disposed on the liquid side of the second heat exchanger 201, so that the first supercooling temperature SC1 may be obtained based on the saturation temperature Tdc and the temperature Te1, and the second supercooling temperature SC2 may be obtained based on the saturation temperature Tdc and the temperature Te2.

In some embodiments, a lower limit of the first supercooling temperature range is greater than zero, and a lower limit of the second supercooling temperature range is greater than zero. An upper limit and lower limit of the first supercooling temperature range and an upper limit and lower limit of the second supercooling temperature range each may be determined by performing simulations in advance. In a case where the first supercooling temperature SC1 is within the first supercooling temperature range, it may be considered that the air conditioner 1000 is operating efficiently in the cooling mode. In a case where the second supercooling temperature SC2 is within the second supercooling temperature range, it may be considered that the air conditioner 1000 is operating efficiently in the heating mode. Here, the efficient operation refers to a condition where the components in the air conditioner 1000 may operate normally, and the air conditioner 1000 may satisfy the cooling or heating demand of the users.

In some embodiments, the first supercooling temperature range may be a range of 3° C. to 8° C. (i.e., (3° C., 8° C.)). For example, the first supercooling temperature range is a range of 3° C. to 4° C. (i.e., (3° C., 4° C.)), a range of 4° C. to 5° C. (i.e., (4° C., 5° C.)), a range of 5° C. to 6° C. (i.e., (5° C., 6° C.)), a range of 6° ° C. to 7° C. (i.e., (6° C., 7° C.)), or a range of 7° C. to 8° C. (i.e., (7° C., 8° C.)). The lesser a first subcooling temperature, the lesser the amount of refrigerant participating in the cycle in the air conditioner 1000. The greater the first subcooling temperature, the greater the amount of refrigerant participating in the cycle in the air conditioner 1000.

In some embodiments, the second supercooling temperature range may be a range of 5° C. to 15° C. (i.e., (5° C., 15° C.)). For example, the second supercooling temperature range is a range of 5° ° C. to 7° C. (i.e., (5° C., 7° C.)), a range of 7° C. to 9° C. (i.e., (7° C., 9° C.)), a range of 9° C. to 11° C. (i.e., (9° C., 11° C.)), a range of 11° C. to 13° C. (i.e., (11° C., 13° C.)), or a range of 13° C. to 15° C. (i.e., (13° C., 15° C.)). The lesser the second subcooling temperature, the lesser the amount of refrigerant participating in the cycle in the air conditioner 1000. The greater the second subcooling temperature, the greater the amount of refrigerant participating in the cycle in the air conditioner 1000.

The operating principle of the air conditioner 1000 is mainly described below by referring to the pressure-enthalpy diagrams of the refrigerant of the air conditioner 1000 in different operating conditions (FIGS. 5 to 8).

It will be noted that, in the pressure-enthalpy diagrams of FIGS. 5 to 8, an abscissa is an enthalpy value h of the refrigerant, and a vertical ordinate is a logarithm lg P of a pressure P of the refrigerant. If a coordinate point is located in a region on a left side of a curve ka, a state of the refrigerant corresponding to the coordinate point is in a supercooled liquid state. If a coordinate point is located in a region on a right side of a curve kb, a state of the refrigerant corresponding to the coordinate point is in a superheated gaseous state. If a coordinate point is located in a region enclosed by the curve ka, the curve kb, and the horizontal axis, a state of the refrigerant corresponding to the coordinate point is in a gas-liquid two-phase state.

In addition, referring to FIG. 3, in the pressure-enthalpy diagrams, a first coordinate point A is a coordinate point of the refrigerant at the air inlet of the gas-liquid separator 107; a second coordinate point B is a coordinate point of the refrigerant at the air outlet $Q_3$ of the compressor 101; a third coordinate point C is a coordinate point of the refrigerant of the liquid side of the first heat exchanger 105; a fourth coordinate point D is a coordinate point of the refrigerant in the first transporting pipe 110; a fifth coordinate point E is a coordinate point of the refrigerant on a side of the second transporting pipe 111 proximate to the liquid storage device 109; a sixth coordinate point F is a coordinate point of the refrigerant on a side of the second transporting pipe 111 proximate to the second throttling device 202; a seventh coordinate point G is a coordinate point of the refrigerant that is on the liquid side of the second heat exchanger 201 and between the second throttling device 202 and the second heat exchanger 201; and an eighth coordinate point H is a coordinate point of the refrigerant of the gaseous side of the second heat exchanger 201.

For example, control methods of the controller 30 in different operating conditions are shown in Table 1.

TABLE 1

| Control methods of a controller in different operating conditions | | | | |
|---|---|---|---|---|
| Operating condition number | Mode of an air conditioner | Length of piping | Amount of refrigerant stored in the air conditioner | Control method |
| First operating condition | Cooling mode | Short | Much | An opening degree of a first throttling device is controlled to be increased |
| Second operating condition | Cooling mode | Long | Less | An opening degree of a first throttling device is controlled to be reduced |
| Third operating condition | Heating mode | Short | Much | An opening degree of a second throttling device is controlled to be increased |
| Fourth operating condition | Heating mode | Long | Less | An opening degree of a second throttling device is controlled to be reduced |

As mentioned above, the length of the piping of the air conditioner 1000 is related to the amount of refrigerant required by the air conditioner 1000. That is to say, In a case where the inner diameter of the piping of the air conditioner 1000 is unchanged and capacities of components in air conditioner 1000 are unchanged, the longer the length of the piping, the greater the capacity of the piping, and the greater the amount of refrigerant required by air conditioner 1000. In a case where the amount of refrigerant required by the air conditioner 1000, corresponding to the length of the piping, is equal to the amount of refrigerant stored in the air conditioner 1000, the length of the piping of the air conditioner 1000 may be considered to be a suitable length of the piping. Therefore, in the above operating conditions, in a case where the length of the piping of the air conditioner 1000 is less than the suitable length of the piping, it may be considered that the length of the piping is short; similarly, in a case where the length of the piping of the air conditioner 1000 is greater than the suitable length of the piping, it may be considered that the length of the piping is long.

In addition, in a certain operating condition, in a case where the amount of refrigerant stored in the air conditioner 1000 is more than the amount of refrigerant required for the normal operation of the air conditioner 1000 in the operating condition, it may be considered that the amount of refrigerant stored in the air conditioner 1000 is much; similarly, in a case where the amount of refrigerant stored in the air conditioner 1000 is less than the amount of refrigerant required for the normal operation of the air conditioner 1000 in the operating condition, it may be considered that the amount of refrigerant stored in the air conditioner 1000 is less.

As shown in Table 1, in the first operating condition, the amount of refrigerant stored in the air conditioner 1000 is much. If the air conditioner 1000 operates with the amount of the current stored refrigerant, much refrigerant reaches the first heat exchanger 105 after passing through the four-way valve 104. In this case, the first heat exchanger 105 changes the gaseous refrigerant with high temperature and high pressure into a supercooled liquid refrigerant with high temperature and high pressure. Therefore, the first supercooling temperature SC1 of the liquid side of the first heat exchanger 105 is high. If the first supercooling temperature SC1 is greater than the upper limit of the first supercooling temperature range, the controller 30 may control the opening degree of the first throttling component 106 to be increased. For example, in a case where the first supercooling temperature SC1 decreases to be within the first supercooling temperature range, or the first throttling device 106 is fully opened, the controller 30 controls the opening degree of the first throttling device 106 to remain unchanged. Here, the first throttling device 106 being fully opened means that the opening degree of the first throttling device 106 reaches a maximum value.

Figure 5:
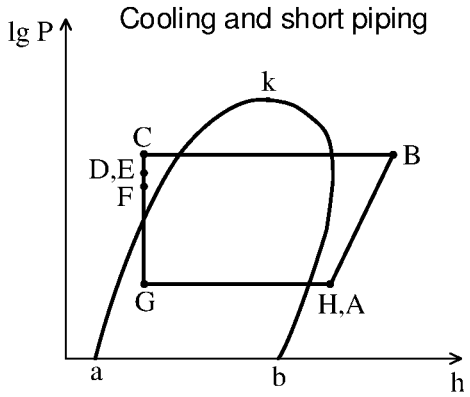
FIG. 5 is a pressure-enthalpy diagram of a refrigerant, in accordance with some embodiments.

Considering an example in which the controller 30 controls the opening degree of the first throttling device 106 to be increased to the maximum value, the states of the refrigerant in positions of the air conditioner 1000 in the first operating condition are shown in FIG. 5. From the second coordinate point B to the third coordinate point C, the gaseous refrigerant with high temperature and high pressure condenses in the first heat exchanger 105 and becomes a supercooled liquid refrigerant with high temperature and high pressure. From the third coordinate point C to the fourth coordinate point D, the refrigerant is throttled by the first throttling device 106. The first throttling device 106 is fully opened and thus has little throttling effect on the refrigerant. Therefore, the refrigerant has a lesser decrease in temperature and pressure after being throttled by the first throttling device 106. In this case, the refrigerant entering into the liquid storage device 109 is a supercooled liquid refrigerant with high temperature and high pressure. Since the temperature and pressure of the refrigerant are basically unchanged after the refrigerant flows through the liquid storage device 109, the fourth coordinate point D and the fifth coordinate point E basically coincide with each other.

From the fifth coordinate point E to the sixth coordinate point F, the refrigerant is transported to the second throttling device 202 through the second transporting pipe 111, and the temperature and pressure of the refrigerant decrease. From the sixth coordinate point F to the seventh coordinate point G, the refrigerant is throttled by the second throttling device 202. Thus, the temperature and pressure of the refrigerant further decrease, and the refrigerant becomes a two-phase refrigerant with low temperature and low pressure. From the seventh coordinate point G to the eighth coordinate point H, the two-phase refrigerant with low temperature and low pressure evaporates in the second heat exchanger 201 and becomes a superheated gaseous refrigerant with low temperature and low pressure, so as to absorb heat and reduce the temperature of indoor space. In a process of the refrigerant flowing back to the gas-liquid separator 107 through the four-way valve 104, the temperature and pressure of the refrigerant are basically unchanged. Therefore, the eighth coordinate point H and the first coordinate point A basically coincide with each other.

Figure 6:
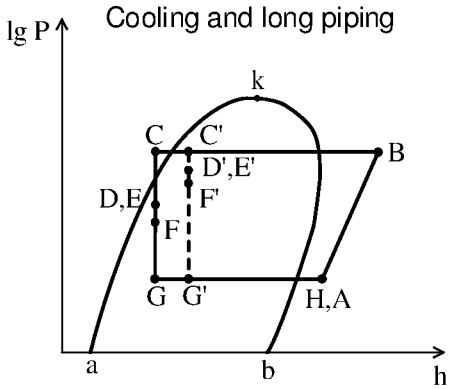
FIG. 6 is another pressure-enthalpy diagram of a refrigerant, in accordance with some embodiments.

In the second operating condition, the amount of refrigerant stored in the air conditioner 1000 is less. If the air conditioner 1000 operates with the amount of the current stored refrigerant, less refrigerant reaches the first heat exchanger 105 after passing through the four-way valve 104. In this case, as shown in FIG. 6, if the opening degree of the first throttling device 106 is large, the gaseous refrigerant with high temperature and high pressure becomes a two-phase refrigerant with high temperature and high pressure corresponding to a coordinate point C' after heat exchange in the first heat exchanger 105. In this way, the first supercooling temperature SC1 of the liquid side of the first heat exchanger 105 has a negative value. That is to say, the first supercooling temperature SC1 is less than the lower limit of the first supercooling temperature range.

In this case, the controller 30 may control the opening degree of the first throttling device 106 to be reduced, so as to enhance the throttling effect of the first throttling device 106 on the refrigerant in the first transporting pipe 110, thereby increasing the dryness fraction of refrigerant in the liquid storage device 109. Since a volume of the gaseous refrigerant of the same mass as the liquid refrigerant is greater than that of the liquid refrigerant, the dryness fraction of the refrigerant in the liquid storage device 109 is increased, and the refrigerant stored in the liquid storage device 109 may be extruded into the second transporting pipe 111. In this way, the amount of refrigerant participating in the cycle in the air conditioner 1000 may be increased, so that the first supercooling temperature SC1 may be increased and within the first supercooling temperature range.

In a case where the first supercooling temperature SC1 is increased to be within the first supercooling temperature range, with continued reference to FIG. 6, the third coordinate point C corresponds to a supercooled liquid refrigerant with high temperature and high pressure. The opening degree of the first throttling device 106 is small, and the first throttling device 106 has a great throttling effect on the refrigerant. Therefore, the refrigerant has a significant decrease in temperature and pressure after being throttled by the first throttling device 106. In this case, the refrigerant entering the liquid storage device 109 is a two-phase refrigerant with medium temperature and medium pressure. It will be noted that, for the state changes of the refrigerant at other positions of the air conditioner 1000 in FIG. 6, reference may be made to the relevant content in FIG. 5, and details are not repeated herein.

In the third operating condition, the principle of the third operating condition is similar to that of the first operating condition, and the second supercooling temperature SC2 of the liquid side of the second heat exchanger 201 of the indoor unit 20 is high. If the second supercooling temperature SC2 of the Nth indoor unit 20 is greater than the upper limit of the second supercooling temperature range, the controller 30 may control the opening degree of the second throttling device 202 of the Nth indoor unit 20 to be increased. For example, in a case where the second supercooling temperature SC2 of the Nth indoor unit 20 is reduced to be within the second supercooling temperature range, or the second throttling device 202 of the Nth indoor unit 20 is fully opened, the controller 30 controls the opening degree of the second throttling device 202 of the Nth indoor unit 20 to remain unchanged. Here, the second throttling device 202 being fully opened means that the opening degree of the second throttling device 202 reaches a maximum value. Where N is a natural number greater than or equal to 1.

Figure 7:
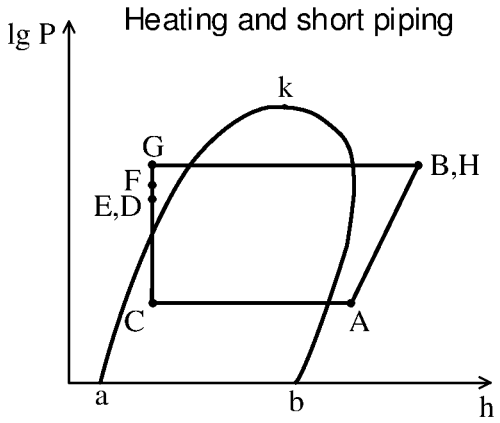
FIG. 7 is yet another pressure-enthalpy diagram of a refrigerant, in accordance with some embodiments.

Considering an example in which the controller 30 controls the opening degree of the second throttling device 202 to be increased to the maximum value, the states of the refrigerant in positions of the air conditioner 1000 in the third operating condition are shown in FIG. 7. From the second coordinate point B to the seventh coordinate point G, the gaseous refrigerant with high temperature and high pressure condenses in the second heat exchanger 201 and becomes a supercooled liquid refrigerant with high temperature and high pressure, so as to release heat to increase the temperature of indoor space. From the seventh coordinate point G to the sixth coordinate point F, the refrigerant is throttled by the second throttling device 202. Since the second throttling device 202 is fully opened, the refrigerant has a lesser decrease in temperature and pressure after being throttled by the second throttling device 202.

From the sixth coordinate point F to the fifth coordinate point E, the refrigerant is transported to the liquid storage device 109 through the second transporting pipe 111, and the temperature and pressure of the refrigerant decrease. In this case, the refrigerant entering into the liquid storage device 109 is a supercooled liquid refrigerant with high temperature and high pressure. Since the temperature and pressure of the refrigerant are basically unchanged after the refrigerant flows through the liquid storage device 109, the fifth coordinate point E and the fourth coordinate point D basically coincide with each other. From the fourth coordinate point D to the third coordinate point C, the refrigerant is throttled by the first throttling device 106. Thus, the temperature and pressure of the refrigerant further decrease. In this case, the refrigerant becomes a two-phase refrigerant with low temperature and low pressure. From the third coordinate point C to the first coordinate point A, the two-phase refrigerant with low temperature and low pressure evaporates in the first heat exchanger 105 and becomes a superheated gaseous refrigerant with low temperature and low pressure.

Figure 8:
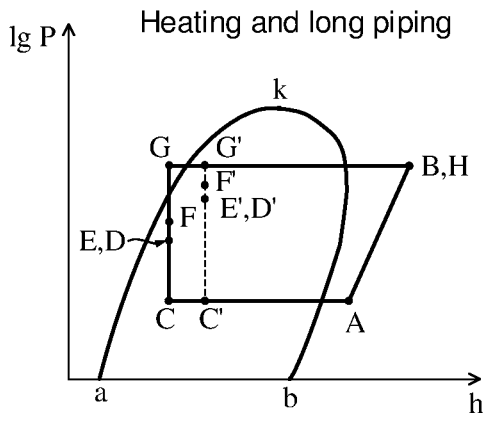
FIG. 8 is yet another pressure-enthalpy diagram of a refrigerant, in accordance with some embodiments.

In the fourth operating condition, the principle of the fourth operating condition is similar to that of the second operating condition. In the fourth operating condition, the amount of refrigerant stored in the air conditioner 1000 is less. As shown in FIG. 8, if the air conditioner 1000 operates with the amount of the current stored refrigerant and the opening degree of the second throttling device 202 is large, the gaseous refrigerant with high temperature and high pressure becomes a two-phase refrigerant with high temperature and high pressure corresponding to the coordinate point G' after heat exchange in the second heat exchanger 201. In this way, the second supercooling temperature SC2 of the liquid side of the second heat exchanger 201 has a negative value. That is to say, the second supercooling temperature SC2 is less than the lower limit of the second supercooling temperature range.

In this case, for the Nth indoor unit 20 whose second supercooling temperature SC2 is less than the lower limit of the second supercooling temperature range, the controller 30 may control the opening degree of the second throttling device 202 of the Nth indoor unit 20 to be reduced, so as to enhance the throttling effect of the second throttling device 202 on the refrigerant in the second transporting pipe 111. As a result, the dryness fraction of the refrigerant in the liquid storage device 109 and the amount of refrigerant participating in the cycle in the air conditioner 1000 are increased, thereby increasing the second supercooling temperature SC2 of the Nth indoor unit 20, so that the second supercooling temperature SC2 may be within the second supercooling temperature range.

In a case where the second supercooling temperature SC2 is increased to be within the second supercooling temperature range, with continued reference to FIG. 8, the supercooled liquid refrigerant with high temperature and high pressure corresponds to the seventh coordinate point G. The opening degree of the second throttling device 202 is small, and the second throttling device 202 has a great throttling effect on the refrigerant. Therefore, the refrigerant has a great decrease in temperature and pressure after being throttled by the second throttling device 202. In this case, the refrigerant entering into the liquid storage device 109 is a two-phase refrigerant with medium temperature and medium pressure. It will be noted that, for the states of the refrigerant at other positions of the air conditioner 1000 in FIG. 8, reference may be made to the relevant content in FIG. 7, and details will not be repeated herein.

In some embodiments, the controller 30 is further configured to regulate the opening degree of the second throttling device 202 in a case where the air conditioner 1000 is in the cooling mode, so that a first superheat temperature SH1 of the gaseous side of the second heat exchanger 201 may be within a preset first superheat temperature range, and to regulate the opening degree of the first throttling device 106 in a case where the air conditioner 1000 is in the heating mode, so that a second superheat temperature SH2 at the air outlet $Q_3$ of the compressor 101 may be within a preset second superheat temperature range.

In the cooling mode, the first superheat temperature SH1 of the gaseous side of the second heat exchanger 201 may affect the state of the refrigerant returning to the compressor 101 after the refrigerant passes through the four-way valve 104 and the gas-liquid separator 107, which may affect the operating state of the air conditioner 1000. Therefore, in the air conditioner 1000 provided by some embodiments of the present disclosure, the first superheat temperature SH1 of the gaseous side of the second heat exchanger 201 may be controlled within the first superheat temperature range on the basis of controlling the first supercooling temperature SC1 to be within the first supercooling temperature range. As a result, the amount of refrigerant participating in the cycle in the air conditioner 1000 may be determined according to the first supercooling temperature SC1 and the first superheat temperature SH1, so that the accuracy of the determined amount of refrigerant may be improved, and thus the stability of the air conditioner 1000 operating in the cooling mode may be further improved, and the operating efficiency of the air conditioner 1000 may be improved.

Similarly, in the heating mode, in the air conditioner 1000 provided by some embodiments of the present disclosure, the second superheat temperature SH2 is controlled to be within the second supercooling temperature range on the basis that the second supercooling temperature SC2 is within the second supercooling temperature range. As a result, the accuracy of the determined amount of refrigerant may be improved, and thus the stability of the air conditioner 1000 operating in the heating mode may be further improved, and the operating efficiency of the air conditioner 1000 may be improved.

In some embodiments, the first superheat temperature SH1 is a difference between a temperature Tg1 of the gaseous side of the second heat exchanger 201 and a saturation temperature Tsc of the refrigerant in an intake pressure Ps of the compressor 101 (i.e., SH1=Tg1−Tsc). The second superheat temperature SH2 is a difference between a temperature Tg2 at the air outlet Qs of the compressor 101 and the saturation temperature Tsc of the refrigerant in the intake pressure Ps of the compressor 101 (i.e., SH2=Tg2−Tsc). For the methods for the controller 30 to obtain the first superheat temperature SH1, the first superheat temperature range, the second superheat temperature SH2, and the second superheat temperature range, reference may be made to the above methods of obtaining the first supercooling temperature SC1, the first supercooling temperature range, the second supercooling temperature SC2, and the second supercooling temperature range, and details will not be repeated herein.

In some embodiments, the controller 30 is configured to control the opening degree of the second throttling device 202 of the Nth indoor unit 20 to be increased, if it is determined that the first superheat temperature SH1 of the Nth indoor unit 20 in one or more indoor units 20 is greater than an upper limit of the first superheat temperature range, in a case where the air conditioner 1000 is in the cooling mode. In this way, the amount of liquid refrigerant flowing into the second heat exchanger 201 of the Nth indoor unit 20 through the second throttling device 202 per unit time may be increased. In a case where the amount of refrigerant evaporating for heat exchange in the second heat exchanger 201 is increased, and the heat in indoor space absorbed by the refrigerant evaporating is unchanged, the heat absorbed by the refrigerant per unit volume in the second heat exchanger 201 decreases. Therefore, by controlling the opening degree of the second throttling device 202 to be increased, it is possible to reduce the first superheat temperature SH1 of the Nth indoor unit 20.

Similarly, if the first superheat temperature of the Nth indoor unit 20 is less than a lower limit of the first superheat temperature range, the controller 30 may control the opening degree of the second throttling component 202 of the Nth indoor unit 20 to be reduced, so as to increase the first superheat temperature SH1 of the Nth indoor unit 20.

In some embodiments, the controller 30 is configured to control the opening degree of the first throttling device 106 to be increased, if it is determined that the second superheat temperature SH2 is greater than an upper limit of the second superheat temperature range, in a case where the air conditioner 1000 is in the heating mode, so that the amount of refrigerant entering the compressor 101 from the first air inlet $Q_1$ of the compressor 101 per unit time may be increased. In this case, in a case where an operating power of the compressor 101 is unchanged, the pressure of the gaseous refrigerant compressed by the compressor 101 decreases, so that the temperature Tg2 of the refrigerant at the air outlet $Q_3$ of the compressor 101 decreases. Therefore, by controlling the opening degree of the first throttling device 106 to be increased, it is possible to reduce the second superheat temperature SH2.

Similarly, if the second superheat temperature SH2 is less than a lower limit of the second superheat temperature range, the controller 30 may control the opening degree of the first throttling device 106 to be reduced, so as to increase the second superheat temperature SH2.

In some embodiments, the air conditioner 1000 includes a plurality of indoor units 20. The controller 30 is further configured to regulate the opening degrees of the plurality of second throttling devices 202 of the plurality of indoor units 20, in a case where the air conditioner 1000 is in the heating mode, so that the plurality of second supercooling temperatures SC2 each may be within the second supercooling temperature range, and an absolute value of a difference between each of the plurality of second supercooling temperatures SC2 and an average value AVE of the plurality of second supercooling temperatures SC2 is less than or equal to a preset first threshold.

In the air conditioner 1000 provided by some embodiments of the present disclosure, by reducing a difference between the plurality of second supercooling temperatures SC2 of the plurality of indoor units 20, it is possible to reduce the difference between the amount of refrigerant in the plurality of indoor units 20, so that the operating states of the plurality of indoor units 20 may be similar to each other. In this way, it is possible to improve the operating balance of the plurality of indoor units 20 in the air conditioner 1000, thereby improving the operating reliability of the air conditioner 1000.

In some examples, if it is determined that the difference between the second supercooling temperature SC2 of the Nth indoor unit 20 in the plurality of indoor units 20 and the average value AVE is greater than the first threshold, the Nth indoor unit 20 has a high second supercooling temperature SC2. In this case, the controller 30 may control the opening degree of the second throttling device 202 of the Nth indoor unit 20 to be increased.

In this way, the throttling effect of the second throttling device 202 on the liquid side of the second heat exchanger 201 of the Nth indoor unit 20 is reduced, so that the decrease in temperature and pressure of the refrigerant of the liquid side of the second heat exchanger 201 may be reduced, and the temperature Te2 of the liquid side of the second heat exchanger 201 may be increased, and the second supercooling temperature SC2 of the Nth indoor unit 20 decreases. Therefore, by controlling the opening degree of the second throttling device 202 of the Nth indoor unit 20 to be increased, it is possible to reduce the second supercooling temperature SC2 of the Nth indoor unit 20.

Similarly, if a difference between the average value AVE and the second supercooling temperature SC2 of the Nth indoor unit 20 is greater than the first threshold, the Nth indoor unit 20 has a low second supercooling temperature SC2. In this case, the controller 30 may control the opening degree of the second throttling component 202 of the Nth indoor unit 20 to be reduced, so as to increase the second supercooling temperature SC2 of the Nth indoor unit 20.

Figure 9:
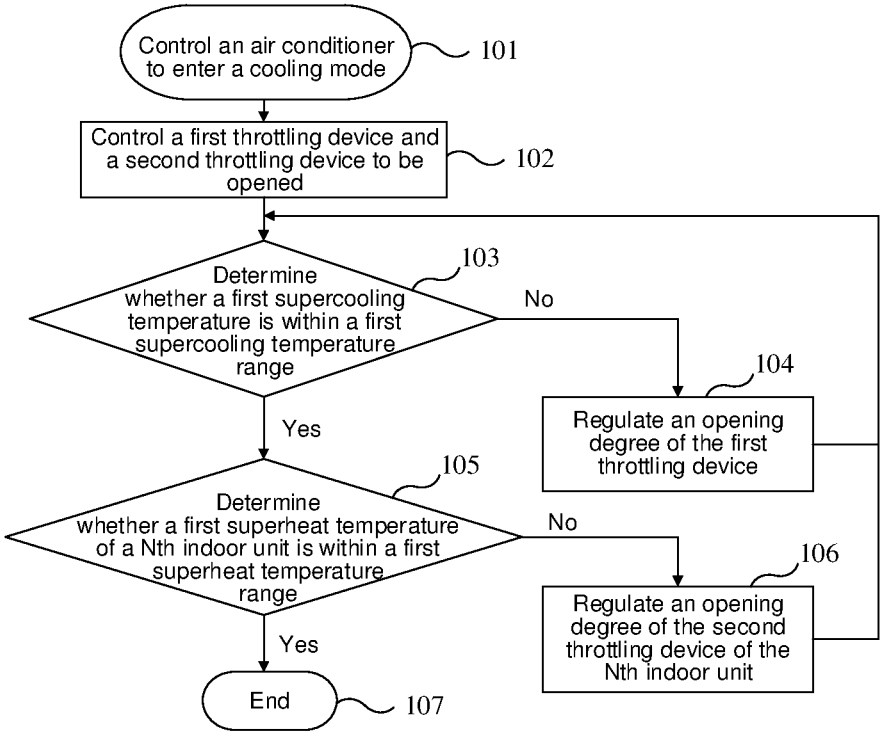
FIG. 9 is a flow chart showing steps performed by a controller, in accordance with some embodiments.

The sequence of the above controls performed by the controller 30 will be described below with reference to two examples. As shown in FIG. 9, the controller 30 is configured to perform step 101 to step 107.

In step 101, the air conditioner 1000 is controlled to enter a cooling mode.

For example, after the user presses a corresponding button on a remote controller or an electric control board of the air conditioner 1000, the remote controller or the electric control board may send a cooling operating instruction to the controller 30, and the controller 30 may perform the step 101 in response to the received cooling operating instruction.

In step 102, the first throttling device 106 and the second throttling device 202 are controlled to be opened.

After the step 101, the controller 30 performs the step 102. For example, the controller 30 controls the first throttling device 106 and the second throttling device 202 to be opened. Then, the controller 30 may obtain the first supercooling temperature SC1 and the first superheat temperature SH1 at regular periods, and determine whether the first supercooling temperature SC1 is within the first supercooling temperature range and whether the first superheat temperature SH1 is within the first superheat temperature range.

It will be noted that the period for the controller 30 to obtain the first supercooling temperature SC1 and the first superheat temperature SH1 may be equal or unequal to each other. FIG. 9 is illustrated by considering an example in which the period for the controller 30 to obtain the first supercooling temperature SC1 is less than the period for the controller 30 to obtain the first superheat temperature SH1. In this case, if the number of times to obtain the first supercooling temperature SC1 is the same as the number of times to obtain the first superheat temperature SH1, the controller 30 first determines whether the first supercooling temperature SC1 is within the first supercooling temperature range (i.e., the controller 30 performs the step 103), and then determines whether the first superheat temperatures SH1 of the indoor units 20 each are within the first superheat temperature range (i.e., the controller 30 performs the step 105).

In step 103, whether the first supercooling temperature SC1 is within the first supercooling temperature range is determined. If not, the controller 30 performs the step 104. If so, the controller 30 performs the step 105.

In step 104, the opening degree of the first throttling device 106 is regulated, so as to increase or reduce the first supercooling temperature SC1 to be within the first supercooling temperature range.

In step 105, whether the first superheat temperature SH1 of the Nth indoor unit 20 is within the first superheat temperature range is determined. If not, the controller 30 performs the step 106. If so, the controller 30 performs the step 107.

In step 106, the opening degree of the second throttling device 202 of the Nth indoor unit 20 is regulated, so as to increase or reduce the first superheat temperature SH1 of the Nth indoor unit 20 to be within the first superheat temperature range.

For example, in a case where N is equal to 3 (i.e., N=3), the controller 30 determines whether the first superheat temperatures SH1 of the three indoor units 20 each are within the first superheat temperature range. If the first superheat temperature SH1 of the second indoor unit 20 in the three indoor units 20 is outside the first superheat temperature range, the controller 30 regulates the opening degree of the second throttling device 202 of the second indoor unit 20, so that the first superheat temperature SH1 of the second indoor unit 20 may be increased or reduced to be within the first superheat temperature range.

In step 107, the current round of control ends.

It will be noted that after the step 104 or the step 106, the controller 30 returns to perform the step 103, so as to re-determine whether the regulated first supercooling temperature SC1 or first superheat temperature SH1 satisfies the condition.

Figure 10:
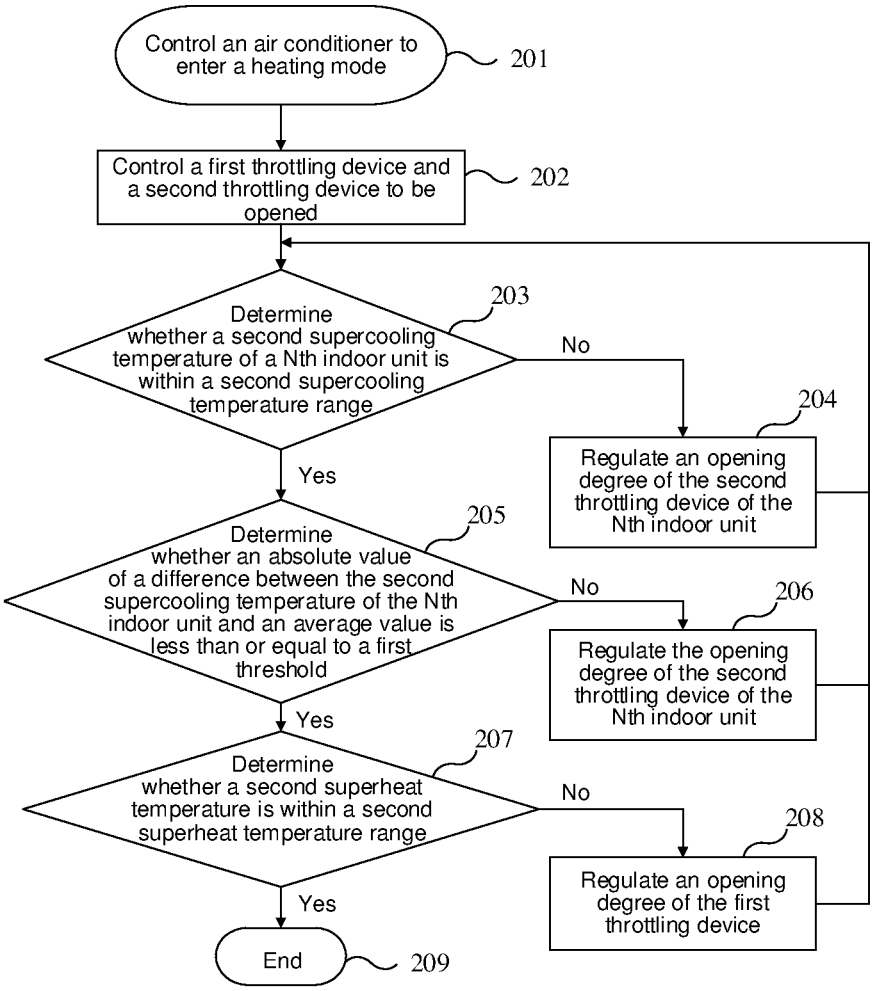
FIG. 10 is another flow chart showing steps performed by a controller, in accordance with some embodiments.

As shown in FIG. 10, the controller 30 is configured to perform step 201 to step 209.

In step 201, the air conditioner 1000 is controlled to enter a heating mode.

It will be noted that, for a triggering condition for the controller 30 to perform the step 201, reference may be made to the relevant content of the triggering condition for the controller 30 to perform the step 101, and the details will not be repeated herein.

In step 202, the first throttling device 106 and the second throttling device 202 are controlled to be opened.

After the step 201, the controller 30 performs the step 202 first. For example, the controller 30 controls the first throttling device 106 and the second throttling device 202 to be opened. It will be noted that the period for the controller 30 to obtain the second supercooling temperature SC2 and the second superheat temperature SH2 may be equal or unequal to each other. FIG. 10 is illustrated by considering an example in which the period for obtaining the second supercooling temperature SC2 is less than the period for obtaining the second superheat temperature SH2. In this case, if the number of times to obtain the second supercooling temperature SC2 is the same as the number of times to obtain the second superheat temperature SH2, the controller 30 first determines whether the second supercooling temperatures SC2 of the indoor units 20 each are within the second supercooling temperature range (i.e., the controller 30 performs the step 203), and then determines whether the second superheat temperature SH2 is within the second superheat temperature range (i.e., the controller 30 performs the step 207).

In step 203, whether the second supercooling temperature SC2 of the Nth indoor unit 20 is within the second supercooling temperature range is determined. If not, the controller 30 performs the step 204. If so, the controller 30 performs the step 205.

In step 204, the opening degree of the second throttling device 202 of the Nth indoor unit 20 is regulated, so as to reduce or increase the second supercooling temperature SC2 of the Nth indoor unit 20 to be within the second supercooling temperature range.

For example, in a case where N is equal to 3 (i.e., N=3), the controller 30 determines whether the second supercooling temperatures SC2 of the three indoor units 20 each are within the second supercooling temperature range. If the second supercooling temperature SC2 of the second indoor unit 20 in the three indoor units 20 is outside the second supercooling temperature range, the controller 30 regulates the opening degree of the second throttling device 202 of the second indoor unit 20, so that the second supercooling temperature SC2 of the second indoor unit 20 may be increased or reduced to be within the second supercooling temperature range.

In step 205, whether the absolute value of the difference between the second supercooling temperature SC2 of the Nth indoor unit 20 and the average value AVE is less than or equal to the first threshold is determined. If not, the controller 30 performs the step 206. If so, the controller 30 performs the step 207.

In step 206, the opening degree of the second throttling device 202 of the Nth indoor unit 20 is regulated, so that the absolute value of the difference between the second supercooling temperature SC2 of the Nth indoor unit 20 and the average value AVE is less than or equal to the first threshold.

For example, in a case where N is equal to 3 (i.e., N=3), the controller 30 determines whether the absolute value of the difference between the second supercooling temperatures SC2 of the three indoor units 20 each and the average value AVE are less than or equal to the first threshold. If the absolute value of the difference between the second supercooling temperature SC2 of the second indoor unit 20 in the three indoor units 20 and the average value AVE is greater than the first threshold, the controller 30 regulates the opening degree of the second throttling device 202 of the second indoor unit 20, so that the absolute value of the difference between the second supercooling temperature SC2 of the second indoor unit 20 and the average value AVE is less than or equal to the first threshold.

In step 207, whether the second superheat temperature SH2 is within the second superheat temperature range is determined. If not, the controller 30 performs the step 208. If so, the controller 30 performs the step 209.

In step 208, the opening degree of the first throttling device 106 is regulated, so as to reduce or increase the second superheat temperature SH2 to be within the second superheat temperature range.

In step 209, the current round of control ends.

Figure 11:
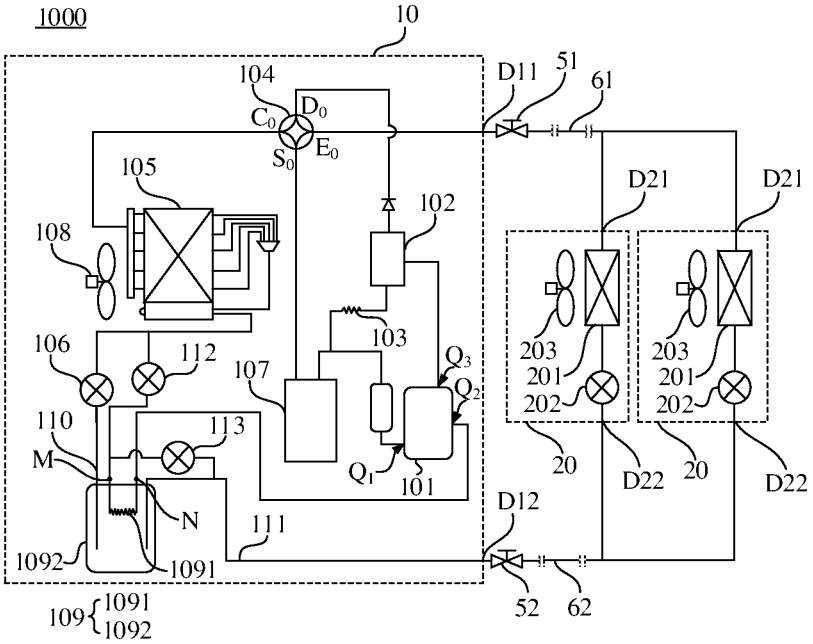
FIG. 11 is a diagram showing another structure of an air conditioner, in accordance with some embodiments.

In some embodiments, compared to FIG. 3, the outdoor unit 10 in FIG. 11 further includes a third throttling device 112 and a fourth throttling device 113, and the liquid storage device 109 includes a body 1092 and a heat exchange pipe 1091 disposed inside the body 1092. The controller 30 may control opening degrees of the third throttling device 112 and the fourth throttling device 113, so as to supply the gaseous refrigerant to the compressor 101 through the heat exchange pipe 1091 and increase the supercooling temperature of the refrigerant in the liquid storage device 109, thereby increasing the first supercooling temperature SC1 of the liquid side of the first heat exchanger 105 or the second supercooling temperature SC2 of the liquid side of the second heat exchanger 201.

A first end of the third throttling device 112 is communicated with the liquid side of the first heat exchanger 105, and a second end of the third throttling device 112 is communicated with an input end M of the heat exchange pipe 1091. An output end N of the heat exchange pipe 1091 is communicated with a second air inlet $Q_2$ of the compressor 101. The third throttling device 112 is configured to control a flow rate of refrigerant flowing into the heat exchange pipe 1091 in a case where the fourth throttling device 113 is closed. A first end of the fourth throttling device 113 is communicated with the input end M of the heat exchange pipe 1091, and a second end of the fourth throttling device 113 is communicated with the liquid side of the second heat exchanger 201. The fourth throttling device 113 is configured to control the flow rate of refrigerant flowing into the heat exchange pipe 1091 in a case where the third throttling device 112 is closed.

It will be noted that the second air inlet $Q_2$ and the first air inlet $Q_1$ may be a same air inlet of the compressor 101. Of course, the second air inlet $Q_2$ and the first air inlet $Q_1$ may also be different air inlets of the compressor 101. For example, the second air inlet $Q_2$ is an opening for refrigerant supplement of the compressor 101.

The controller 30 is further configured to control the fourth throttling device 113 to be closed and the third throttling device 112 to be opened, in a case where the air conditioner 1000 is in the cooling mode and the first supercooling temperature SC1 is within the first supercooling temperature range, so as to supercool the refrigerant outside the heat exchange pipe 1091 and supply the gaseous refrigerant to the compressor 101, and to control the third throttling device 112 to be closed and the fourth throttling device 113 to be opened, in a case where the air conditioner 1000 is in the heating mode and the second supercooling temperature SC2 is within the second supercooling temperature range, so as to supercool the refrigerant outside the heat exchange pipe 1091 and supply the gaseous refrigerant to the compressor 101.

In the air conditioner 1000 in the cooling mode, the controller 30 may control the third throttling device 112 to be opened in a case where the first supercooling temperature SC1 is controlled to be within the first supercooling temperature range, so that a portion of the refrigerant condensing in the first heat exchanger 105 may enter the heat exchange pipe 1091 after passing through the third throttling device 112. In this case, the liquid refrigerant entering the heat exchange pipe 1091 may be vaporized into the gaseous refrigerant in the heat exchange pipe 1091, and the gaseous refrigerant may be transported to the second air inlet $Q_2$ of the compressor 101, so as to supply the gaseous refrigerant to the compressor 101, thereby reducing the pressure of the compressor 101 during the operation and the possibility of liquid refrigerant appearing at the air inlets (e.g., the first air inlet $Q_1$ and the second air inlet $Q_2$) of the compressor 101.

In addition, the vaporized refrigerant in the heat exchange pipe 1091 may also absorb the heat of the refrigerant in the liquid storage device 109, so as to increase the supercooling temperature of the refrigerant in the liquid storage device 109 and avoid a problem of the decrease in the supercooling temperature due to the decrease in the amount of refrigerant entering into the liquid storage device 109, so that the first supercooling temperature SC1 may be within the first supercooling temperature range and the operating effect of the air conditioner 1000 may be improved.

It will be noted that, considering the first operating condition as an example, in a case where the refrigerant completes a cooling cycle and returns to the first air inlet $Q_1$ of the compressor 101, the refrigerant is a superheated gaseous refrigerant with low temperature and low pressure. In this case, the temperature of the refrigerant is low, and a portion of the refrigerant is likely to become liquid refrigerant. However, the refrigerant entering the heat exchange pipe 1091 is a liquid refrigerant with high temperature and high pressure, and the gaseous refrigerant with high temperature and high pressure may be obtained after heat exchange in the heat exchange pipe 1091, and the gaseous refrigerant with high temperature and high pressure is supplemented into the compressor 101.

In this way, the superheated gaseous refrigerant with low temperature and low pressure in the compressor 101 that has completed a cooling cycle is mixed with the gaseous refrigerant with high temperature and high pressure from the heat exchange pipe 1091, so as to increase the temperature of the refrigerant entering the compressor 101 and reduce the possibility of liquid refrigerant appearing at the air inlets of the compressor 101, thereby improving the reliability of the compressor 101.

In some embodiments, the controller 30 is configured to control the third throttling device 112 to be opened at a first opening degree, in a case where the air conditioner 1000 is in the cooling mode and the first supercooling temperature SC1 is within the first supercooling temperature range, obtain a first temperature of the input end M of the heat exchange pipe 1091 and a second temperature of the output end N of the heat exchange pipe 1091, and determine whether a difference between the second temperature and the first temperature is greater than or equal to a preset second threshold.

If the difference between the second temperature and the first temperature is greater than or equal to the second threshold, the temperature difference between the two ends of the heat exchange pipe 1091 is large, and the states of the refrigerant at the two ends of the heat exchange pipe 1091 are different. That is to say, the refrigerant in the heat exchange pipe 1091 changes from a liquid state to a gaseous state after the refrigerant in the heat exchange pipe 1091 exchanges heat with the refrigerant outside the heat exchange pipe 1091. In this case, the controller 30 controls the opening degree of the third throttling device 112 to remain unchanged.

If the difference between the second temperature and the first temperature is less than the second threshold, the refrigerant in the heat exchange pipe 1091 is still in a liquid state or has changed from a liquid state to a gas-liquid two-phase state after the refrigerant in the heat exchange pipe 1091 exchanges heat with the refrigerant outside the heat exchange pipe 1091. In this case, the controller 30 controls the opening degree of the third throttling device 112 to be increased, so as to increase the amount of refrigerant flowing into the heat exchange pipe 1091 and improve the heat exchange effect of the refrigerant in the heat exchange pipe 1091. In this way, in the cooling mode of the air conditioner 1000, the refrigerant entering the compressor 101 through the heat exchange pipe 1091 may be a gaseous refrigerant with high temperature, and the heat exchange pipe 1091 may has a supercooling effect on the refrigerant in the liquid storage device 109.

It will be noted that the controller 30 may control the opening degree of the third throttling device 112 to be increased or reduced by a first preset value each time until the difference between the second temperature and the first temperature is greater than or equal to the second threshold. Alternatively, the controller 30 may control the opening degree of the third throttling device 112 to a minimum value or a maximum value.

In some embodiments, the controller 30 is further configured to: obtain the first supercooling temperature SC1 every preset period and regulate the opening degree of the first throttling device 106 after controlling the third throttling device 112 to be opened at the first opening degree, so that the first supercooling temperature SC1 is within the first supercooling temperature range after the third throttling device 112 is opened.

Since a portion of the refrigerant flows into the heat exchange pipe 1091, the amount of refrigerant flowing into the first transporting pipe 110 through the first throttling device 106 decreases, so that the first supercooling temperature SC1 of the liquid side of the first heat exchanger 105 decreases. In order to ensure that the first supercooling temperature SC1 is within the first supercooling temperature range, the controller 30 may control the opening degree of the first throttling device 106 to be reduced, so as to increase the first supercooling temperature SC1. Therefore, in the air conditioner 1000 provided by some embodiments of the present disclosure, the first supercooling temperature SC1 may be controlled to be within the first supercooling temperature range by regulating the opening degree of the first throttling device 106 after controlling the heat exchange pipe 1091 to start heat exchange, so that the air conditioner 1000 may operate stably and efficiently in the cooling mode.

It will be noted that the controller 30 may control the opening degree of the first throttling device 106 to be increased or reduced by a second preset value each time until the first supercooling temperature SC1 is within the first supercooling temperature range. Alternatively, the controller 30 may control the opening degree of the first throttling device 106 to a minimum value or a maximum value.

In some embodiments, the controller 30 is configured to control the fourth throttling device 113 to be opened at a second opening degree, in a case where the air conditioner 1000 is in the heating mode and the second supercooling temperature SC2 is within the second supercooling temperature range, obtain the first temperature of the input end M of the heat exchange pipe 1091 and the second temperature of the output end N of the heat exchange pipe 1091, and determine whether the difference between the second temperature and the first temperature is greater than or equal to the preset second threshold.

If the difference between the second temperature and the first temperature is greater than or equal to the second threshold, the refrigerant in the heat exchange pipe 1091 changes from a liquid state to a gaseous state after exchanging heat with the refrigerant outside the heat exchange pipe 1091. In this case, the controller 30 controls the opening degree of the fourth throttling component 113 to remain unchanged.

If the difference between the second temperature and the first temperature is less than the second threshold, the refrigerant in the heat exchange pipe 1091 is still liquid or has changed from a liquid state to a gas-liquid two-phase state after exchanging heat with the refrigerant outside the heat exchange pipe 1091. In this case, the controller 30 controls the opening degree of the fourth throttling device 113 to be increased, so as to increase the amount of refrigerant flowing into the heat exchange pipe 1091 and improve the heat exchange effect of the refrigerant in the heat exchange pipe 1091. In this way, in the heating mode of the air conditioner 1000, the refrigerant entering the compressor 101 through the heat exchange pipe 1091 may be a gaseous refrigerant with high temperature, and the heat exchange pipe 1091 may have a supercooling effect on the refrigerant in the liquid storage device 109.

It will be noted that the controller 30 may control the opening degree of the fourth throttling device 113 to be increased or reduced by a third preset value each time until the difference between the second temperature and the first temperature is greater than or equal to the second threshold. Alternatively, the controller 30 may control the opening degree of the fourth throttling component 113 to a minimum value or a maximum value.

In some embodiments, the controller 30 is further configured to obtain the second supercooling temperature SC2 every preset period and regulate the opening degree of the second throttling device 202, after controlling the fourth throttling device 113 to be opened at the second opening degree, so that the second supercooling temperature SC2 may be within the second supercooling temperature range after the fourth throttling device 113 is opened.

After the heat exchange pipe 1091 is controlled to start heat exchange, the second supercooling temperature SC2 may be controlled to be within the second supercooling temperature range by regulating the opening degree of the second throttling device 202, so that the air conditioner 1000 may operate stably and efficiently in the heating mode.

It will be noted that the controller 30 may control the opening degree of the second throttling device 202 to be increased or reduced by a fourth preset value each time until the second supercooling temperature SC2 is within the second supercooling temperature range. Alternatively, the controller 30 may control the opening degree of the second throttling device 202 to a minimum value or a maximum value.

It will be noted that the steps performed by the controller 30 may apply to a case of one or more indoor units 20, and the present disclosure is not limited thereto.

The liquid storage device 109 in some embodiments of the present disclosure will be described in detail below.

Figure 12:
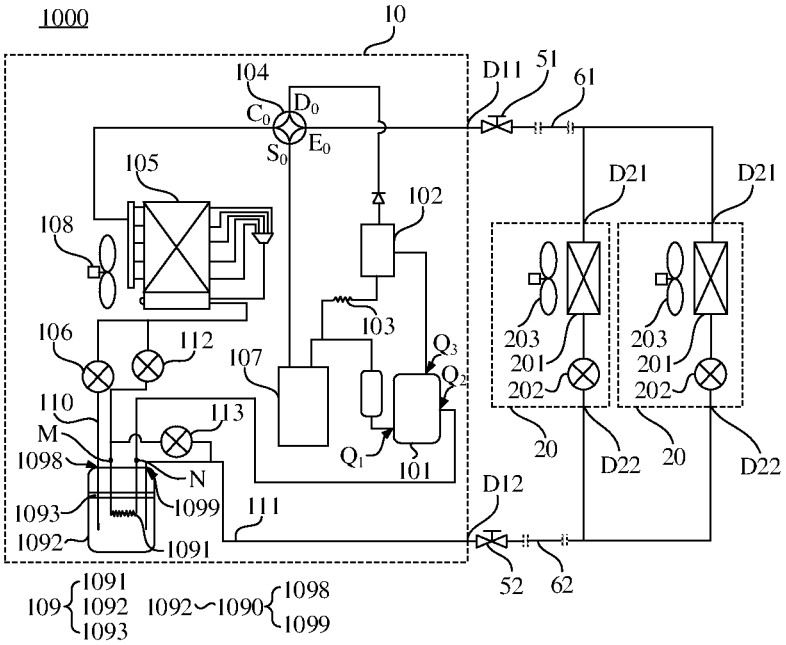
FIG. 12 is a diagram showing yet another structure of an air conditioner, in accordance with some embodiments.

As shown in FIG. 12, the liquid storage device 109 includes a body 1092, a heat exchange pipe 1091, and a separator 1093. The body 1092 includes a plurality of openings 1090 communicating with the first throttling device 106 and the second throttling device 202, respectively. For example, the plurality of openings 1090 include a first opening 1098 and a second opening 1099, the first transporting pipe 110 passes through the first opening 1098 and communicates with an interior space of the body 1092, and the second transporting pipe 111 passes through the second opening 1099 and communicates with the interior space of the body 1092.

The heat exchange pipe 1091 is located inside the body 1092. The input end M of the heat exchange pipe 1091 extends to the outside of the body 1092 and communicates with the liquid side of the first heat exchanger 105 or the liquid side of the second heat exchanger 201, and the output end N of the heat exchange pipe 1091 extends to the outside of the body 1092 and communicates with the second air inlet $Q_2$ of the compressor 101. The heat exchange pipe 1091 is configured to supercool the refrigerant outside the heat exchange pipe 1091 and supplement the gaseous refrigerant to the compressor 101.

Figure 13:
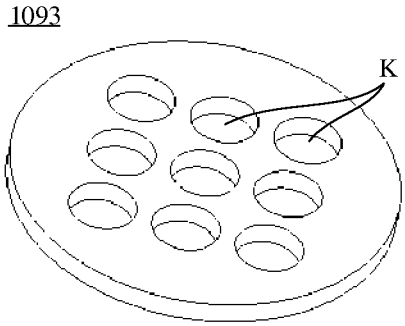
FIG. 13 is a diagram showing a structure of a separator, in accordance with some embodiments.

The separator 1093 is located inside the body 1092. As shown in FIG. 13, the separator 1093 includes a plurality of air holes K. The separator 1093 is configured to perform a gas-liquid separation on the refrigerant in the body 1092, so as to control the amount of refrigerant participating in the cycle in the air conditioner 1000 by controlling the dryness fraction of the refrigerant in the liquid storage device 109.

In the air conditioner 1000 provided by some embodiments of the present disclosure, the separator 1093 is disposed in the body 1092. In a case where the separator 1093 is submerged in the liquid refrigerant in the liquid storage device 109, a portion of the gaseous refrigerant in the liquid refrigerant may adhere to a surface of the separator 1093 having the plurality of air holes K. In a case where the separator 1093 is located in the gaseous refrigerant in the liquid storage device 109, if the two-phase refrigerant bubbles formed by the gaseous refrigerant enveloping the liquid refrigerant reach the surface of the separator 1093, the two-phase refrigerant bubbles burst, and the gaseous refrigerant in the bubbles passes through the air holes K of the separator 1093 and reaches a side of the separator 1093, while the liquid refrigerant in the bubbles stays on another side of the separator 1093.

Figure 14:
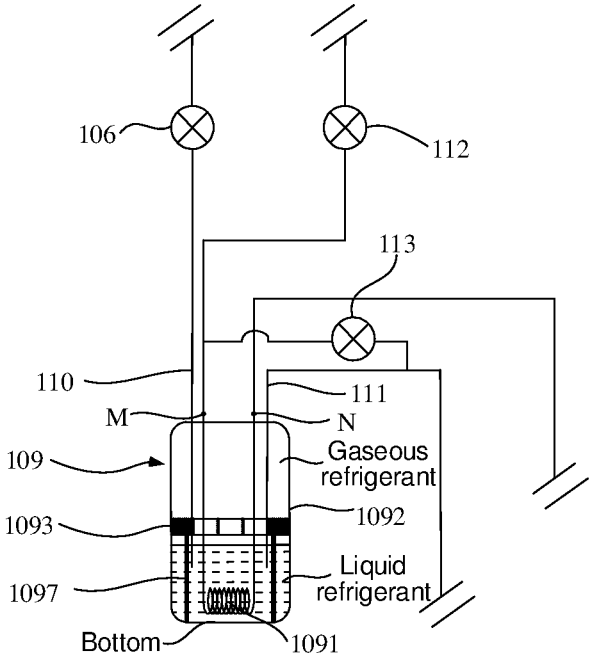
FIG. 14 is a diagram showing a structure of a liquid storage device, in accordance with some embodiments.

In this way, as shown in FIG. 14, it is possible to perform gas-liquid separation on the refrigerant in the liquid storage device 109 through the separator 1093, so that the liquid refrigerant in the liquid storage device 109 may be located below the gaseous refrigerant, which is conducive to controlling the amount of refrigerant participating in the cycle in the air conditioner 1000 by controlling the dryness fraction of the refrigerant in the liquid storage device 109.

For example, in a case where the dryness fraction of the refrigerant in the liquid storage device 109 is increased, the gaseous refrigerant in the liquid storage device 109 is increased, and a liquid level (i.e., a junction between the gaseous refrigerant and the liquid refrigerant) of the liquid storage device 109 decreases. The liquid refrigerant in the liquid storage device 109 may be pressed into the first transporting pipe 110 or the second transporting pipe 111, so as to increase the amount of refrigerant participating in the cycle in the air conditioner 1000. Alternatively, in a case where the dryness fraction of the refrigerant in the liquid storage device 109 decreases, the gaseous refrigerant in the liquid storage device 109 decreases, and the liquid level in the liquid storage device 109 rises. A portion of the refrigerant participating in the cycle in the air conditioner 1000 may enter into the liquid storage device 109 and be stored in the liquid storage device 109, so that the amount of refrigerant participating in the cycle in the air conditioner 1000 may be reduced.

In some embodiments, as shown in FIG. 14, an end of the first transporting pipe 110 away from the first heat exchanger 105 and an end of the second transporting pipe 111 away from the second heat exchanger 201 extend into the inside of the body 1092 and pass through the separator 1093 and are submerged in the liquid refrigerant in the liquid storage device 109. In this way, a density of the two-phase refrigerant entering the liquid storage device 109 through the first transporting pipe 110 or the second transporting pipe 111 is less than a density of the liquid refrigerant in the liquid storage device 109. Therefore, the two-phase refrigerant may float up and pass through the separator 1093, so that the gaseous refrigerant and liquid refrigerant in the two-phase refrigerant are separated by the separator 1093, thereby improving the gas-liquid separation efficiency of the separator 1093 on the refrigerant.

In addition, the heat exchange pipe 1091 is located between the separator 1093 and a bottom of the body 1092, and the input end M and output end N of the heat exchange pipe 1091 pass through the separator 1093 and extend to the outside of the body 1092. In this way, the heat exchange pipe 1091 may be submerged in the liquid refrigerant in the liquid storage device 109, so as to increase the supercooling temperature of the liquid refrigerant through the heat exchange pipe 1091.

In some embodiments, an outer contour of the separator 1093 is matched with an inner contour of the body 1092. Here, a contour of a corresponding component may be construed as a contour of an orthogonal projection of the component on a horizontal plane. In this way, it is possible to reduce a gap between the outer contour of the separator 1093 and the inner contour of the body 1092, so as to reduce the probability that the refrigerant entering the liquid storage device 109 passes through the separator 1093 through the gap, thereby improving the gas-liquid separation efficiency of the separator 1093 on the refrigerant in the liquid storage device 109.

In some embodiments, the refrigerant in the body 1092 is separated into a gaseous refrigerant and a liquid refrigerant by the separator 1093. A density of a material of the separator 1093 is less than a density of the liquid refrigerant and greater than a density of the gaseous refrigerant, so that the separator 1093 may float at the junction between the gaseous refrigerant and the liquid refrigerant. In this way, the separator 1093 may move with the change of the liquid level in the liquid storage device 109, so as to ensure the gas-liquid separation effect of the separator 1093 on the two-phase refrigerant entering into the liquid refrigerant and improve the gas-liquid separation effect.

In some other embodiments, with continued reference to FIG. 14, the liquid storage device 109 further includes a supporting member 1097. A first end of the supporting member 1097 is fixedly connected to the bottom of the body 1092, and a second end of the supporting member 1097 is fixedly connected to a side of the separator 1093 proximate to the bottom of the body 1092, so as to fix the separator 1093 in the liquid storage device 109. In this way, it is possible to improve the reliability of fixing the separator 1093.

Figure 15:
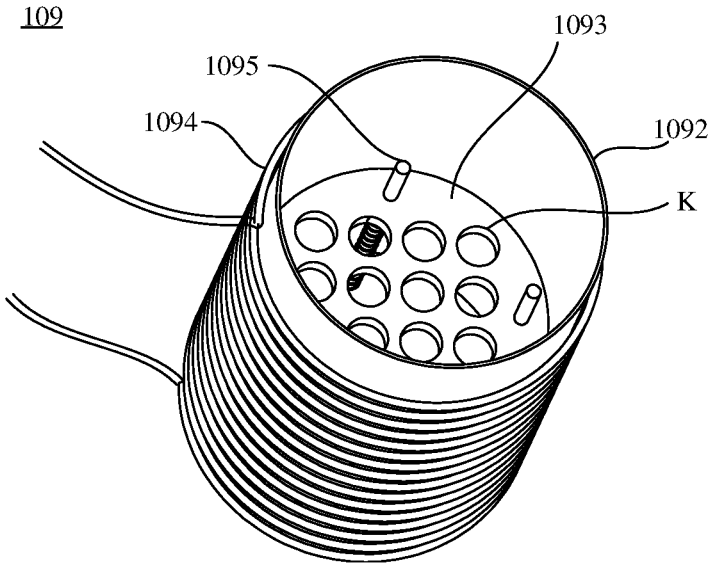
FIG. 15 is a diagram showing another structure of a liquid storage device, in accordance with some embodiments.
Figure 16:
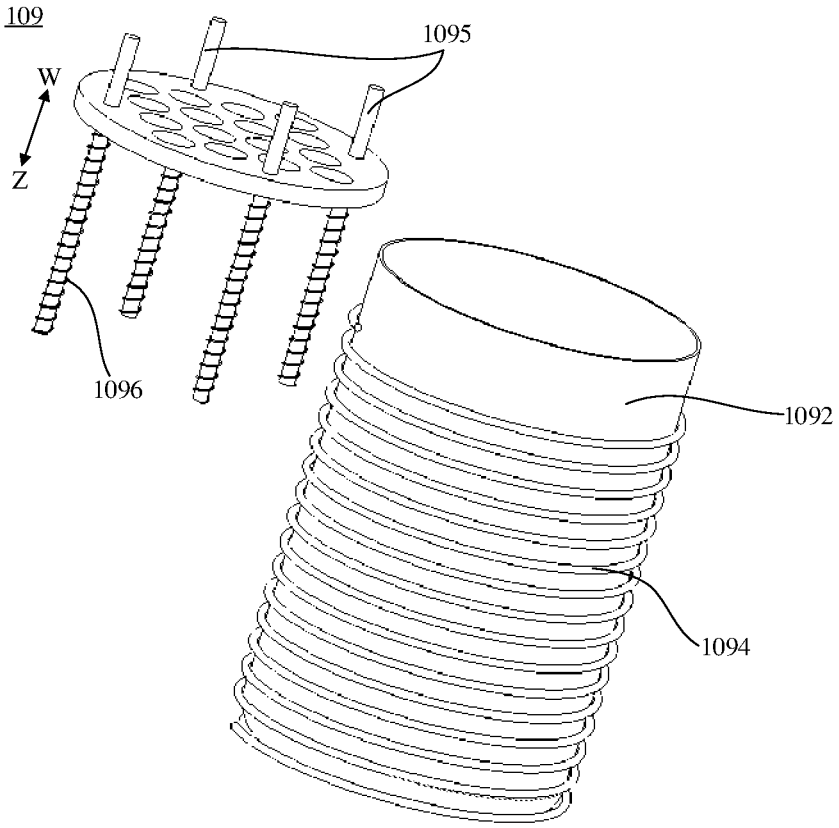
FIG. 16 is a diagram showing yet another structure of a liquid storage device, in accordance with some embodiments.

In some embodiments, the material of the separator 1093 includes a magnetic material. Moreover, as shown in FIGS. 15 and 16, the liquid storage device 109 further includes a plurality of solenoids 1094 disposed on a side wall of the body 1092. After the plurality of solenoids 1094 are powered on, the separator 1093 may move with the change of the magnetic field generated by the plurality of solenoids 1094. In this way, the position of the separator 1093 may be changed by changing the current in the plurality of solenoids 1094. Of course, the moving direction of the separator 1093 may also be changed by changing a direction of the current in the plurality of solenoids 1094.

For example, the controller 30 may periodically change the direction of the current in the plurality of solenoids 1094, so as to make the separator 1093 reciprocate up and down in the body 1092, so that the separator 1093 may be in contact with the refrigerant at different positions in the body 1092, thereby improving the gas-liquid separation efficiency of the separator 1093.

With continued reference to FIGS. 15 and 16, in some embodiments, the liquid storage device 109 further includes at least one guiding member 1095 disposed on the bottom of the body 1092. The separator 1093 is sleeved onto the guiding member 1095, so that the guiding member 1095 may limit the moving direction of the separator 1093. For example, the guiding member 1095 includes a rod, and the separator 1093 is provided with a through hole, and the rod passes through the through hole. In this way, the separator 1093 may move along an extending direction of the guiding member 1095, so as to improve the stability of the movement of the separator 1093.

In some embodiments, with continued reference to FIG. 16, the liquid storage device 109 further includes an energy storage member 1096. A first end of the energy storage member 1096 is fixedly connected to the side of the separator 1093 proximate to the bottom of the body 1092, and a second end of the energy storage member 1096 is fixedly connected to the bottom of the body 1092. The energy storage member 1096 is configured to store kinetic energy during the movement of the separator 1093, so as to provide power for the separator 1093 to move in a direction proximate to or away from the bottom of the body 1092.

For example, the energy storage member includes elastic members such as springs or corrugated pipes. When the separator 1093 moves in a direction proximate to the bottom of the body 1092 (e.g. the direction Z in FIG. 16), the spring is compressed to accumulate elastic force. Then, when the separator 1093 moves in a direction away from the bottom of the body 1092 (e.g., the direction W in FIG. 16), the elastic force accumulated in the spring is released to provide power for the separator 1093, which is conducive to saving energy consumption.

To sum up, in some embodiments of the present disclosure, the air conditioner 1000 may adaptively allocate the amount of refrigerant participating in the cycle in the air conditioner 1000 and the amount of refrigerant stored in the liquid storage device 109, so that the air conditioner 1000 may operate with an appropriate amount of refrigerant, thereby improving the operating effect of the air conditioner 1000.

In addition, the air conditioner 1000 may also vaporize the refrigerant through the heat exchange pipe 1091 and transport the vaporized gaseous refrigerant to the second air inlet $Q_2$ of the compressor 101, so as to supplement the gaseous refrigerant to the compressor 101, thereby reducing the operation pressure of the compressor 101, and reducing the possibility of liquid refrigerant appearing in the air inlet of the compressor 101. When the refrigerant is vaporized through the heat exchange pipe 1091, the heat of the refrigerant in the liquid storage device 109 may also be absorbed, so that the supercooling temperature of the refrigerant in the liquid storage device 109 may be increased, and the first supercooling temperature SC1 may be within the first supercooling temperature range or the second supercooling temperature SC2 may be within the second supercooling temperature range, thereby improving the operating effect of the air conditioner 1000.

Moreover, in some embodiments of the present disclosure, the gaseous refrigerant and liquid refrigerant in the refrigerant in the liquid storage device 109 may be separated by the separator 1093, so that the liquid refrigerant in the liquid storage device 109 may be located below the gaseous refrigerant, which is conducive to controlling the dryness fraction of the refrigerant in the liquid storage device 109 and the amount of refrigerant participating in the cycle in the air conditioner 1000.

In the above description of the embodiments, specific features, structures, materials, or characteristics may be combined in a suitable manner in any one or more embodiments or examples.

A person skilled in the art will understand that the scope of disclosure in the present disclosure is not limited to specific embodiments discussed above and may modify and substitute some elements of the embodiments without departing from the spirits of the present disclosure. The scope of the present disclosure is limited by the appended claims.

What is claimed is:

1. An air conditioner, comprising:

an outdoor unit, including:

a compressor configured to compress a refrigerant, so as to drive the refrigerant to circulate in the air conditioner;

a first heat exchanger configured to perform one of liquefaction and vaporization of the refrigerant;

a liquid storage device configured to store the refrigerant; and a first throttling device, a first end of the first throttling device communicating with a liquid side of the first heat exchanger, and a second end of the first throttling device communicating with the liquid storage device;

a plurality of indoor units communicating with the outdoor unit, each of the plurality of indoor units including:

a second heat exchanger configured to perform another one of the liquefaction and the vaporization of the refrigerant; and a second throttling device, a first end of the second throttling device communicating with a liquid side of the second heat exchanger, and a second end of the second throttling device communicating with the liquid storage device; and a controller coupled to the first throttling device and the second throttling device, the controller being configured to regulate amount of the refrigerant in the in the liquid storage device by regulating an opening degree of at least one of the first throttling device or the second throttling device, so as to regulate the amount of refrigerant participating in a cycle in the air conditioner; wherein the first throttling device is configured to regulate a flow rate of the refrigerant flowing through the first throttling device through the controller, the second throttling device is configured to regulate a flow rate of the refrigerant flowing through the second throttling device through the controller;

the controller is further configured to:

regulate the opening degree of the first throttling device, in a case where the air conditioner is in a cooling mode, so that a first supercooling temperature of the liquid side of the first heat exchanger is within a preset first supercooling temperature range; and regulate the opening degree of the second throttling device, in a case where the air conditioner is in a heating mode, so that a plurality of second supercooling temperatures of the liquid sides of the plurality of second heat exchangers each are within a preset second supercooling temperature range, and an absolute value of a difference between each of the plurality of second supercooling temperatures and an average value of the plurality of second supercooling temperatures is less than or equal to a preset first threshold.

2. The air conditioner according to claim 1, wherein the controller is configured to:

control the opening degree of the first throttling device to be increased, if it is determined that the first supercooling temperature is greater than an upper limit of the first supercooling temperature range, in a case where the air conditioner is in the cooling mode; and control the opening degree of the first throttling device to be reduced, if it is determined that the first supercooling temperature is less than a lower limit of the first supercooling temperature range.

3. The air conditioner according to claim 1, wherein the controller is configured to:

control the opening degree of the second throttling device of a Nth indoor unit to be increased, if it is determined that the second supercooling temperature of the Nth indoor unit of the plurality of indoor units is greater than an upper limit of the second supercooling temperature range, in a case where the air conditioner is in the heating mode; and control the opening degree of the second throttling device of the Nth indoor unit to be reduced, if it is determined that the second supercooling temperature of the Nth indoor unit is less than a lower limit of the second supercooling temperature range.

4. The air conditioner according to claim 1, wherein the controller is further configured to:

regulate the opening degree of the second throttling device, in a case where the air conditioner is in the cooling mode, so that a first superheat temperature of a gaseous side of the second heat exchanger is within a preset first superheat temperature range; and regulate the opening degree of the first throttling device, in a case where the air conditioner is in the heating mode, so that a second superheat temperature at an air outlet of the compressor is within a preset second superheat temperature range.

5. The air conditioner according to claim 4, wherein the controller is configured to:

control the opening degree of the second throttling device of a Nth indoor unit to be increased, if it is determined that the first superheat temperature of the Nth indoor unit of the plurality of indoor units is greater than an upper limit of the first superheat temperature range, in a case where the air conditioner is in the cooling mode; and control the opening degree of the second throttling device of the Nth indoor unit to be reduced, if it is determined that the first superheat temperature of the Nth indoor unit is less than a lower limit of the first superheat temperature range.

6. The air conditioner according to claim 4, wherein the controller is configured to:

control the opening degree of the first throttling device to be increased, if it is determined that the second superheat temperature is greater than an upper limit of the second superheat temperature range, in a case where the air conditioner is in the heating mode; and control the opening degree of the first throttling device to be reduced, if it is determined that the second superheat temperature is less than a lower limit of the second superheat temperature range.

7. The air conditioner according to claim 1, wherein the controller is configured to:

control the opening degree of the second throttling device of a Nth indoor unit to be increased, if it is determined that the difference between the second supercooling temperature of the Nth indoor unit of the plurality of indoor units and the average value is greater than the first threshold; and control the opening degree of the second throttling device of the Nth indoor unit to be reduced, if it is determined that a difference between the average value and the second supercooling temperature of the Nth indoor unit is greater than the first threshold.

8. The air conditioner according to claim 1, wherein the liquid storage device includes a body and a heat exchange pipe disposed in the body, and the outdoor unit further includes:

a third throttling device, a first end of the third throttling device communicating with the liquid side of the first heat exchanger, and a second end of the third throttling device communicating with an input end of the heat exchange pipe, an output end of the heat exchange pipe communicating with an air inlet of the compressor, the third throttling device being configured to control a flow rate of the refrigerant flowing into the heat exchange pipe in a case where a fourth throttling device is closed; and the fourth throttling device, a first end of the fourth throttling device communicating with the input end of the heat exchange pipe, and a second end of the fourth throttling device communicating with the liquid side of the second heat exchanger, the fourth throttling device being configured to control the flow rate of the refrigerant flowing into the heat exchange pipe in a case where the third throttling device is closed;

wherein the controller is further configured to:

control the fourth throttling device to be closed and the third throttling device to be opened, in a case where the air conditioner is in the cooling mode and the first supercooling temperature is within the first supercooling temperature range, so as to subcool the refrigerant outside the heat exchange pipe and supplement a gaseous refrigerant to the compressor; and control the third throttling device to be closed and the fourth throttling device to be opened, in a case where the air conditioner is in the heating mode and the second supercooling temperature is within the second supercooling temperature range, so as to subcool the refrigerant outside the heat exchange pipe and supplement the gaseous refrigerant to the compressor.

9. The air conditioner according to claim 8, wherein the controller is configured to:

control the third throttling device to be opened at a first opening degree, in a case where the air conditioner is in the cooling mode and the first supercooling temperature is within the first supercooling temperature range;

obtain a first temperature at the input end of the heat exchange pipe and a second temperature at the output end of the heat exchange pipe;

control an opening degree of the third throttling device to remain unchanged, if it is determined that a difference between the second temperature and the first temperature is greater than or equal to a preset second threshold; and control the opening degree of the third throttling device to be increased, if it is determined that the difference between the second temperature and the first temperature is less than the second threshold.

10. The air conditioner according to claim 9, wherein the controller is further configured to:

obtain the first supercooling temperature every preset period and regulate the opening degree of the first throttling device, after controlling the third throttling device to be opened at the first opening degree, so that the first supercooling temperature is within the first supercooling temperature range after the third throttling device is opened.

11. The air conditioner according to claim 8, wherein the controller is configured to:

control the fourth throttling device to be opened at a second opening degree, in a case where the air conditioner is in the heating mode and the second supercooling temperature is within the second supercooling temperature range;

obtain a first temperature at the input end of the heat exchange pipe and a second temperature at the output end of the heat exchange pipe;

control the opening degree of the fourth throttling device to remain unchanged, if it is determined that a difference between the second temperature and the first temperature is greater than or equal to a preset second threshold; and control the opening degree of the fourth throttling device to be increased, if it is determined that the difference between the second temperature and the first temperature is less than the second threshold.

12. The air conditioner according to claim 11, wherein the controller is further configured to:

obtain the second supercooling temperature every preset period and regulate the opening degree of the second throttling device, after controlling the fourth throttling device to be opened at the second opening degree, so that the second supercooling temperature is within the second supercooling temperature range after the fourth throttling device is opened.

13. The air conditioner according to claim 1, wherein the liquid storage device includes:

a body including a plurality of openings, the body communicating with the first throttling device and the second throttling device through the plurality of openings, respectively;

a heat exchange pipe disposed in the body, an input end of the heat exchange pipe extending outside the body and communicating with the liquid side of the first heat exchanger or the liquid side of the second heat exchanger, an output end of the heat exchange pipe extending outside the body and communicating with an air inlet of the compressor, the heat exchange pipe being configured to supercool the refrigerant outside the heat exchange pipe and supply a gaseous refrigerant to the compressor; and a separator disposed in the body, the separator including a plurality of air holes, and the separator being configured to perform gas-liquid separation on the refrigerant in the body, so as to separate the refrigerant in the body into the gaseous refrigerant and a liquid refrigerant.

14. The air conditioner according to claim 13, wherein the outdoor unit further includes a first transporting pipe, and the a second end of the first throttling device communicates with the liquid storage device through the first transporting pipe; the indoor unit further includes a second transporting pipe, and the a second end of the second throttling device communicates with the liquid storage device through the second transporting pipe; an end of the first transporting pipe away from the first heat exchanger and an end of the second transporting pipe away from the second heat exchanger extend into an inside of the body through the separator; and the heat exchange pipe is located between the separator and a bottom of the body, and the input end of the heat exchange pipe and the output end of the heat exchange pipe extend outside the body through the separator.

15. The air conditioner according to claim 13, wherein an outer contour of the separator matches with an inner contour of the body.

16. The air conditioner according to claim 13, wherein a density of a material of the separator is less than a density of the liquid refrigerant and greater than a density of the gaseous refrigerant, so that the separator floats at a junction of the gaseous refrigerant and the liquid refrigerant.

17. The air conditioner according to claim 13, wherein a material of the separator includes a magnetic material; the liquid storage device further includes a plurality of solenoids disposed on a side wall of the body and configured to generate a magnetic field after being powered on, so that the separator moves with a change of the magnetic field.

18. The air conditioner according to claim 13, wherein the liquid storage device further includes a guiding member disposed on a bottom of the body, the separator is sleeved onto the guiding member, and the guiding member is configured to limit a moving direction of the separator.

19. The air conditioner according to claim 13, wherein the liquid storage device further includes an energy storage member, a first end of the energy storage member is fixedly connected to a surface of a side of the separator adjacent to a bottom of the body, and a second end of the energy storage member is fixedly connected to the bottom of the body; the energy storage member is configured to store kinetic energy during a movement of the separator, so as to provide power for the separator to move in a direction toward or away from the bottom of the body.

* * * * *